US007382989B2

(12) United States Patent
Takei

(10) Patent No.: US 7,382,989 B2
(45) Date of Patent: Jun. 3, 2008

(54) IMAGE FORMING SYSTEM WITH EXCHANGE UNIT MOUNTED THEREIN

(75) Inventor: Kenichi Takei, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 257 days.

(21) Appl. No.: 11/052,955

(22) Filed: Feb. 9, 2005

(65) Prior Publication Data

US 2005/0254836 A1 Nov. 17, 2005

(30) Foreign Application Priority Data

May 17, 2004 (JP) ..... 2004-146148

(51) Int. Cl.
*G03G 15/00* (2006.01)

(52) U.S. Cl. ..... 399/12

(58) Field of Classification Search ..... 399/8, 399/12, 24, 25, 31, 85
See application file for complete search history.

(56) References Cited

U.S. PATENT DOCUMENTS

| | | | | |
|---|---|---|---|---|
| 5,351,107 | A * | 9/1994 | Nakane et al. | 399/49 |
| 6,212,338 | B1 * | 4/2001 | Hagihara et al. | 399/12 |
| 6,625,402 | B2 * | 9/2003 | Takemoto | 399/8 |
| 6,738,903 | B1 * | 5/2004 | Haines | 713/168 |
| 7,139,494 | B2 * | 11/2006 | Ono et al. | 399/12 |
| 2003/0063914 | A1 * | 4/2003 | Masuda et al. | 399/12 |
| 2004/0240893 | A1 * | 12/2004 | Sato et al. | 399/8 |
| 2005/0078165 | A1 * | 4/2005 | Harada et al. | 347/137 |
| 2005/0254831 | A1 * | 11/2005 | Soga et al. | 399/12 |
| 2005/0254833 | A1 * | 11/2005 | Yokoe | 399/12 |
| 2005/0254835 | A1 * | 11/2005 | Takei | 399/12 |
| 2005/0254837 | A1 * | 11/2005 | Takahashi | 399/12 |
| 2005/0254838 | A1 * | 11/2005 | Takahashi | 399/12 |
| 2005/0254839 | A1 * | 11/2005 | Nagamine et al. | 399/12 |
| 2005/0254841 | A1 * | 11/2005 | Tomitaka | 399/12 |

FOREIGN PATENT DOCUMENTS

| | | | |
|---|---|---|---|
| JP | 06118795 | A * | 4/1994 |
| JP | 06-149051 | A | 5/1994 |
| JP | 2602341 | B2 | 1/1997 |
| JP | 10-133528 | A | 5/1998 |
| JP | 11296022 | A * | 10/1999 |
| JP | 2000-284581 | | 10/2000 |
| JP | 2001-100598 | A | 4/2001 |
| JP | A-2001-147620 | | 5/2001 |
| JP | 3476704 | B2 | 9/2003 |

* cited by examiner

*Primary Examiner*—Robert Beatty
(74) *Attorney, Agent, or Firm*—Oliff & Berridge, PLC

(57) ABSTRACT

It is judged whether or not an exchange unit mounted in an image forming apparatus is a genuine one. If judged that a nongenuine unit is mounted there, it is judged at the next step whether not a control parameter is optimized. If judged that the control parameter is optimized, it is judged at the next step whether or not the control parameter is optimized in a local environment. If not optimized in the local environment, an optimal parameter is downloaded from a website.

8 Claims, 22 Drawing Sheets

IMAGE FORMING SYSTEM WITH EXCHANGE UNIT MOUNTED THEREIN

BACKGROUND OF THE INVENTION

1. Field of the Invention

The present invention relates to an image forming system, and more particularly to an image forming system having an image forming apparatus in which an exchange unit is exchangeably mounted in a main body thereof.

2. Background Art

An image forming apparatus adapted to allow a user to easily exchange a unit containing consumables or the like has been known.

Meanwhile, in a case where the unit exchanged by the user is other than genuine ones produced by an original manufacturer of the image forming apparatus, the following problems may occur. That is, the capability of the image forming apparatus cannot fully be exerted. For example, picture quality is degraded. Proper operations cannot be ensured. Alternatively, a failure may occur. This is because the image forming apparatus controls the process of forming an image in view of characteristics of toners, those of an image carrier, charging characteristics, cleaning characteristics, and fixing characteristics.

Thus, to maintain the picture quality of an image forming apparatus and to prevent occurrence of problems, JP-A-10-133528 discloses a method of providing in a genuine exchange part a data carrier for holding consumed-amount data of a consumable and of comparing a consumed amount, which is detected by a consumed-amount detection portion provided in a main body of the apparatus, with the consumed-amount data, which is held by the data carrier, to thereby judge whether or not the consumable is supplied to the genuine exchange part.

Further, JP-A-6-149051 discloses the techniques of providing in a toner cartridge storage unit for storing predetermined code data and of inhibiting, when a main body of a copier cannot read predetermined code data from the storage unit, from copying.

Furthermore, JP-A-2001-100598 discloses a method of performing an alarm display and inhibition of printing when empty information written to a cartridge at the detection of a run-out of toner is read from a cartridge replenished with toner.

Also, Japanese Patent No. 2602341 discloses a method of storing the count of generated images in a memory of a cartridge and of making, when a preset termination count representing the number of images, which can be generated by using the cartridge, is equal to the count of generated images, the cartridge unusable thereafter.

Additionally, Japanese Patent No. 3476704 discloses a method of facilitating the detection of nonconformity of a toner replenishment container by setting image forming conditions, which are deteriorated as compared with proper image forming conditions, in a case where it is detected by two-way communication between a container-side communication unit of the toner replenishment container and a main-body-side communication unit of the main body of the apparatus that the toner replenishment container is inadequate, and where it is selected by a selection input unit that a replenishing operation is continued by ignoring the nonconformity of the toner replenishment container.

SUMMARY OF THE INVENTION

A first object of the invention is to provide an image forming system adapted so that even when an exchange unit, which is other than genuine ones, is mounted therein, such an exchange unit can be used by a user's will. Also, a second object of the invention is to provide an image forming system enabled to perform an optimal control operation even when an exchange unit, which is other than genuine ones, is mounted therein.

To achieve the aforementioned objects, according to a first aspect of the invention, there is provided an image forming system that includes an image forming apparatus, which includes an apparatus main body, at least one exchange unit, exchangeably mounted in the main body, and a control unit for performing a control operation by selecting one of a first operation mode, which is associated with an exchange unit that is a genuine unit, and a second operation mode, which is associated with an exchange unit that is other than genuine units, and a providing unit for providing a control parameter, which are applied to the second operation mode, to the control unit.

Preferably, the control parameter provided by the providing unit relates to a consumed amount of an exchange unit or to an environment of the image forming apparatus.

The providing unit may provide the control parameter directly to the image forming apparatus manually. However, preferably, the providing unit is provided in a host apparatus connected to the image forming apparatus, and the control parameter is provided from this host apparatus. Alternatively, the providing unit is provided in a Web server, and provides the control parameter through the Internet.

Also, according to a second aspect of the invention, there is provided an image forming system that includes an image forming apparatus, which includes an apparatus main body, at least one exchange unit, exchangeably mounted in the main body, and a control unit for performing a control operation by selecting one of a first operation mode, which is associated with an exchange unit that is a genuine unit, and a second operation mode, which is associated with an exchange unit that is other than genuine units, and a host apparatus connected to the image forming apparatus. The host apparatus includes a providing unit for providing a control parameter, which is applied to the second operation mode, to the control unit.

Also, according to a third aspect of the invention, there is provided an image forming system that includes an image forming apparatus, which includes an apparatus main body, at least one exchange unit, exchangeably mounted in the main body, and a control unit for performing a control operation by selecting one of a first operation mode, which is associated with an exchange unit that is a genuine unit, and a second operation mode, which is associated with an exchange unit that is other than genuine units, a host apparatus connected to the image forming apparatus, and a providing unit for providing a control parameter, which is applied to the second operation mode, to the control unit through the host apparatus.

Also, according to a fourth aspect of the invention, there is provided an image forming system that includes an apparatus main body, at least one exchange unit, exchangeably mounted in the main body, a control unit for performing a control operation by selecting one of a first operation mode, which is associated with an exchange unit that is a genuine unit, and a second operation mode, which is associated with an exchange unit that is other than genuine units, an optimal control parameter generating unit for generating an optimal control parameter, which is applied to the second operation mode, and a providing unit for providing an optimal parameter, which is generated by the optimal control parameter generating unit, to the control unit through the host apparatus.

According to the invention, the image forming system is operable even when a device, which is other than genuine ones, is provided therein as an exchange unit. Even in such a case, optimal control thereof is possible.

BRIEF DESCRIPTION OF THE DRAWINGS

These and other objects and advantages of this invention will become more fully apparent from the following detailed description taken with the accompanying drawings in which:

FIG. 16A illustrates the corrected toner concentration; and FIG. 16B is a graph illustrating the corrected image density;

DETAILED DESCRIPTION OF THE PREFERRED EMBODIMENTS

Next, an embodiment of the invention is described hereinbelow with the accompanying drawings.

Figure 1:
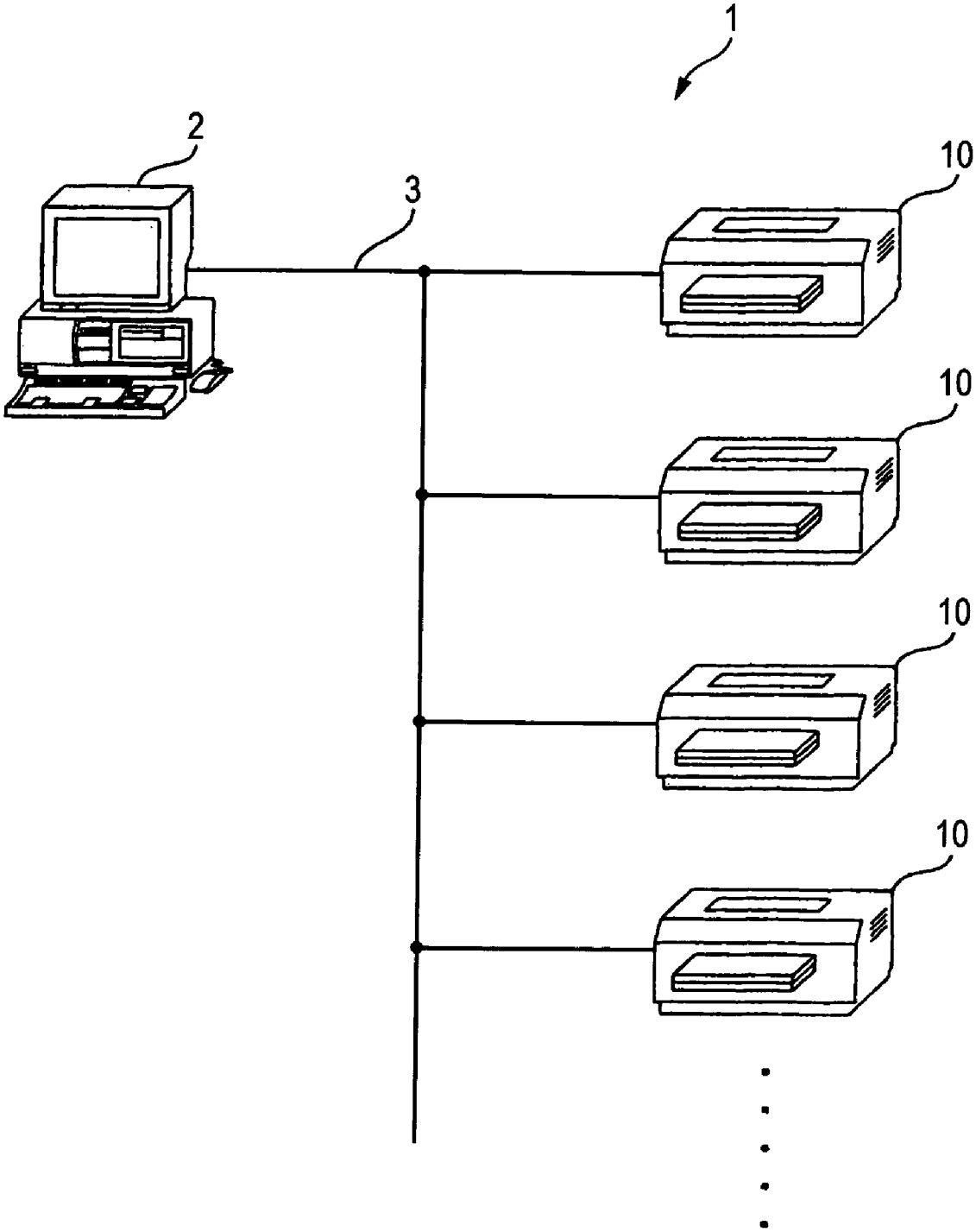
FIG. 1 is a schematic view illustrating an image forming system according to an embodiment of the invention.

FIG. 1 illustrates an image forming system 1 according to the embodiment of the invention. The image forming system 1 is configured by connecting a host apparatus, such as a PC (Personal Computer) 2, is connected through a network 3 to, for example, plural image forming apparatuses 10. The host apparatus 2 may be a terminal other than a PC, which has a control unit, for example, a MCU (Micro Controller Unit), an input/output apparatus, such as a touch panel, and a communication apparatus for transmitting and receiving signals through the network 3. The network 3 may be either a wired one or a wireless one. Further, plural host apparatuses 2 may be connected to the network 3. One or both of the host apparatus 2 and the image forming apparatus 10 are connected to the Internet.

Figure 2:
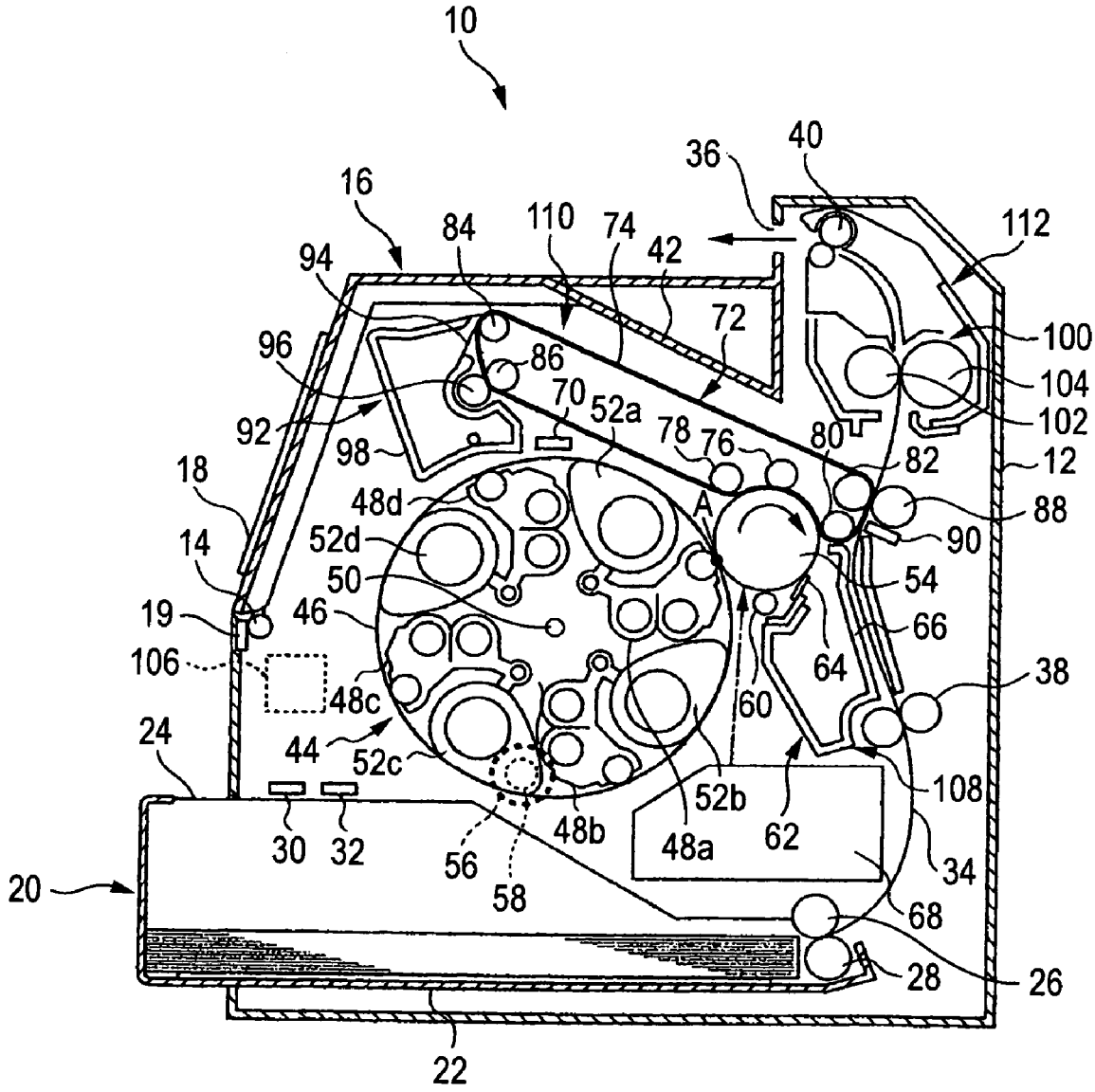
FIG. 2 is a side view illustrating an outline of an image forming apparatus according to the embodiment of the invention.

FIG. 2 illustrates an outline of the image forming apparatus 10. The image forming apparatus 10 has a main body 12 thereof. An opening/closing cover 16 is provided at an upper portion in such a way as to be able to turn around a turn support point 14. For instance, a user interface (UI) apparatus 18 is provided in front (at the left side, as viewed in FIG. 2) of an opening/closing cover 16. The UI apparatus 18 displays control information and designation information concerning the image forming apparatus 10, and receives the designation information inputted by a user. For example, a user can select a monochrome mode, in which the image forming apparatus 10 forms a monochrome image, or a color mode, in which the image forming apparatus 10 forms a full color image, through the UI apparatus 18. That is, a user can operate the image forming apparatus 10 through the UI apparatus 18. Incidentally, the UI apparatus 18 may be adapted to either only receive input from a switch or the like, or only output indication. Alternatively, the UI apparatus 18 may perform the combination thereof.

Also, an opening/closing detection sensor 19 for detecting the opening and closing of the opening/closing cover 16 by, for instance, being separated therefrom and contacted thereto in response to the opening and closing thereof is provided in the vicinity of the turn support point 14.

For example, a single-tier paper feed unit 20 is disposed at a lower portion of the main body 12 of the image forming apparatus. The paper feed unit 20 has a body 22 thereof and a paper feed cassette 24, which accommodates sheets of paper. A feed roll 26 for supplying sheets of paper from the paper feed cassette 24, and a retard roll 28 for handling the supplied sheets of paper sheet by sheet are disposed at an upper part in the vicinity of the rear end of the paper feed cassette 24. Further, a temperature sensor 30 for detecting the temperature in the main body 12 of the image forming apparatus, and a humidity sensor 32 for detecting the humidity in the main body 12 thereof are provided above the paper feed cassette 24.

A conveying path 34 is a path for paper from a feed roll 26 to a discharge port 36. This conveying path 34 is formed in the vicinity of the back side (the right side surface, as viewed in FIG. 2) of the main body 12 of the image forming apparatus in such a way as to substantially vertically extend from the paper feed unit 20 to the fixing device 100 (to be described later). A secondary transfer roll 88 and a secondary transfer backup roll 82, which will be described later, are disposed at an upstream side from the fixing device 100 of this conveying path 34. A resist roll 38 is disposed at the upstream side of the secondary transfer roll 88 and the secondary transfer backup roll 82. Furthermore, a discharge roll 40 is disposed in the vicinity of the discharge port 36

Therefore, sheets of paper fed by the feed roll 26 from the paper feed cassette 24 of the paper feed device 20 are handled by the retard roll 28 so that only the topmost sheet of paper is led to the conveying path 34 and then temporarily stopped by the resist roll 38. Subsequently, this sheet of paper is passed between the secondary transfer roll 88 and the second transfer backup roll 82, which will be described later, with appropriate timing, so that a toner image is transferred. This transferred toner image is fixed by the fixing device 100. Then, this sheet of paper is discharged by the discharge roll 40 from the discharge port 36 to a discharge portion 42 provided at an upper part of the opening/closing cover 16. This discharge portion 42 is gradually upwardly inclined from the discharge port, which is low, to the front (that is, in the leftward direction, as viewed in FIG. 2).

For example, a developing device unit 44, such as a rotary developing device, is disposed substantially at the central portion of the main body 12 of the image forming apparatus. The developing device unit 44 has a body 46 thereof, in which four developing devices 48*a* to 48*d* for forming toner images are mounted. These developing devices 48*a* to 48*d* rotate around a rotation shaft 50 counterclockwise (that is, anticlockwise, as viewed in FIG. 2) together with the body 46 thereof. Cylindrical toner cartridges 52*a* to 52*d*, which accommodate yellow toner (Y), magenta toner (M), cyan toner (C), and black toner (K), are mounted in the developing devices 48*a* to 48*d*, respectively. The toner cartridges 52*a* to 52*d* are adapted so that when mounted in the body 46 through the developing devices 48*a* to 48*d*, the outer surface thereof coincides with the outer periphery of the body 46.

An image carrier 54 constituted by, for instance, a photoreceptor is disposed in such a manner as to abut against the developing device unit 44 from the rear side (the right-hand side, as viewed in FIG. 2) of the image forming apparatus 10. That is, the developing device unit 44 is adapted so that four colors Y, M, C, K are available for full color developing, that the developing devices 48*a* to 48*d* are rotation-moved to and positioned at places opposed to the image carrier 54, respectively, and that the developing devices 48*a* to 48*d* develop a latent image formed on the image carrier 54 color by color by using yellow toner (Y), magenta toner (M), cyan toner (C), and black toner (K).

Also, a wireless communication section 56 is disposed in the proximity of a place substantially opposed to the image carrier 54 across the rotation shaft 50 of the developing device unit 44. The wireless communication section 56 has an antenna 58 and makes wireless communication with a memory chip 170 (to be described later).

A charging device 60 constituted by, for instance, a charging roll for uniformly charging this image carrier 54 is provided under the image carrier 54. Further, an image carrier cleaner 62 abuts against the upstream side from the charging device 60 placed in the direction of rotation of the image carrier 54. The image carrier cleaner 62 is constituted by a cleaning blade 64, which rakes out residual toner on the image carrier 54 after first transfer, and a waste toner collection bottle 66 for collecting the toner raked out by the cleaning blade 64.

Incidentally, for examples, a rib or the like is formed on the rear side (the right-hand side, as viewed in FIG. 2) of the waste toner collection bottle 66. Thus, the rear side thereof is formed like a curved surface in such a way as to smoothly convey the paper, and constitutes a part of the conveying path 34.

An exposure device 68 for writing a latent image on the image carrier 54 charged by the charging device 60 by using light rays, such as laser light rays, is disposed under the rear side of the developing device unit 44. Further, an unused-state detection sensor, such as a reflection type photosensor, 70 for detecting whether or not the toner cartridges 52*a* to 52*d* mounted in the developing device unit 44 are unused is disposed above the developing device unit 44. An intermediate transfer device 72 for collectively transferring toner images onto a sheet of paper at a secondary transfer position (to be described later) after superposing four color toner images on an intermediate transfer member 74 by primary-transferring the toner image, which is visualized by the developing device unit 44, at a primary transfer position every perimeter of the intermediate transfer member 74 color by color is provided above the developing device unit 44 and the unused-state detection sensor 70.

The intermediate transfer device 72 includes the intermediate transfer member, such as an intermediate transfer belt, 74, a primary transfer roll 76, a wrap-in roll 78, a wrap-out roll 80, a secondary transfer backup roll 82, a scraper backup roll 84, and a brush backup roll 86. The intermediate transfer member 74 has, for instance, elasticity, and is stretched substantially flat in such a manner as to have long sides and short sides above the developing device unit 44. The long side at the top-side of the intermediate transfer member 74 is stretched in such a way as to be substantially parallel to the discharge portion 42 provided at the upper part of the main body 12 of the image forming apparatus. Further, the intermediate transfer member 74 has a primary transfer portion (an image carrier wrap area), which abuts against the image carrier 54 like a wrap between the wrap-in roll 78 disposed at the upstream-side of the primary transfer roll 76 on the long side at the bottom surface side thereof, and the wrap-out roll 80 disposed downstream from the primary transfer roll 76. The intermediate transfer member 74 winds around the image carrier 54 only within a predetermined range and is driven by the rotation of the image carrier 54.

Furthermore, a planar portion (corresponding to the short side) is formed by the wrap-out roll 80 and the secondary transfer backup roll 82 on the back side (the right-hand side surface thereof, as viewed in FIG. 2) of the intermediate transfer member 74. This planar portion is adapted to serve as the secondary transfer portion and to face the conveying path 34.

Thus, the intermediate transfer member 74, on which the yellow, magenta, cyan and black toner images formed on the image carrier 54 are primary-transferred in that order in the order by the primary transfer roll 76, conveys the toner image to the secondary transfer portion.

The scraper backup roll 84 assists a scraper 94 in raking out the residual toner on the intermediate transfer member 74 after the secondary transfer. The brush backup roll 86 assists a brush roll 96 in raking out the residual toner on the intermediate transfer member 74 after the secondary transfer.

The secondary transfer backup roll 82 of the intermediate transfer device 72 faces the secondary transfer roll 88 across the conveying path 34. That is, a position between the second transfer roll 88 and the secondary transfer backup roll 82 is set to be a secondary transfer position. The secondary transfer roll 88 is assisted by the secondary transfer backup roll 82 in secondary-transferring the toner images, which are primary-transferred onto the intermediate transfer member 74, onto the sheet of paper at the secondary transfer position. Incidentally, the secondary transfer roll 88 is adapted to be separated from the intermediate transfer member 74 during three revolutions of the intermediate transfer member 74, that is, during the three color toner images, namely, the yellow toner image, the magenta toner image, and the cyan toner image are conveyed, and also adapted to abut against the intermediate transfer member 74 when the black toner image is transferred. Additionally, a predetermined difference in potential is caused between the secondary transfer roll 88 and the secondary transfer backup roll 82. For example, in a case where the secondary transfer roll 88 is set at a high voltage, the secondary transfer backup roll 82 is connected to the ground (GND).

An image density sensor 90, for example, a reflection type photosensor is disposed upstream from the secondary transfer position in such a way as to face the intermediate transfer member 74 across the conveying path 34. The image density sensor 90 reads a patch of toner formed on the intermediate transfer member 74 and detects the density of an image formed on the intermediate transfer member 74.

An intermediate transfer member cleaner 92 is provided at an inverted-image carrier side end of the intermediate transfer member 74 in such a way as to abut thereagainst. The intermediate transfer cleaner 92 includes, for example, a scraper 94 for raking out the residual toner on the intermediate transfer member 74 after the secondary transfer, the brush roll 96 for further raking out the residual toner still left after the cleaning by the scraper 94, and the waste toner collection bottle 98 for collecting the toner raked by the scraper 94 and the brush roll 96. The scraper 94 is constituted by, for instance, a stainless thin plate. A voltage, whose polarity is opposite to that of the voltage applied to the toner, is applied thereto. The brush roll 96 is constituted by, for example, an acrylic brush subjected to conductive treatment. Additionally, during the intermediate transfer member 74 conveys the toner image, the scraper 94 and the brush roll 96 are separated from the intermediate transfer member 74, and made to integrally abut thereagainst with predetermined timing.

The fixing device 100 is disposed above the secondary transfer position. The fixing device 100 has a heating roll 102 and a pressure roll 104 and is operative to fixing the toner images, which are secondary-transferred onto a sheet of paper by the secondary transfer roll 88 and the secondary transfer backup roll 82, onto the sheet of paper and to convey the fixed toner image to a discharge roll 40.

Further, the control portion 106 for controlling constituent portions of the image forming apparatus 10 is disposed in the main body 12 thereof.

An image carrier unit 108 is formed by integrating the image carrier 54, the charging device 60, and the image carrier cleaner 62 with one another. Furthermore, an image forming unit 110 is formed by integrating the image carrier unit 108, the intermediate transfer device 72, and the intermediate transfer member cleaner 92 with one another. Additionally, the fixing unit 112 is formed by integrating the fixing device 100 and the discharge roll 40 with one another.

Figure 3:
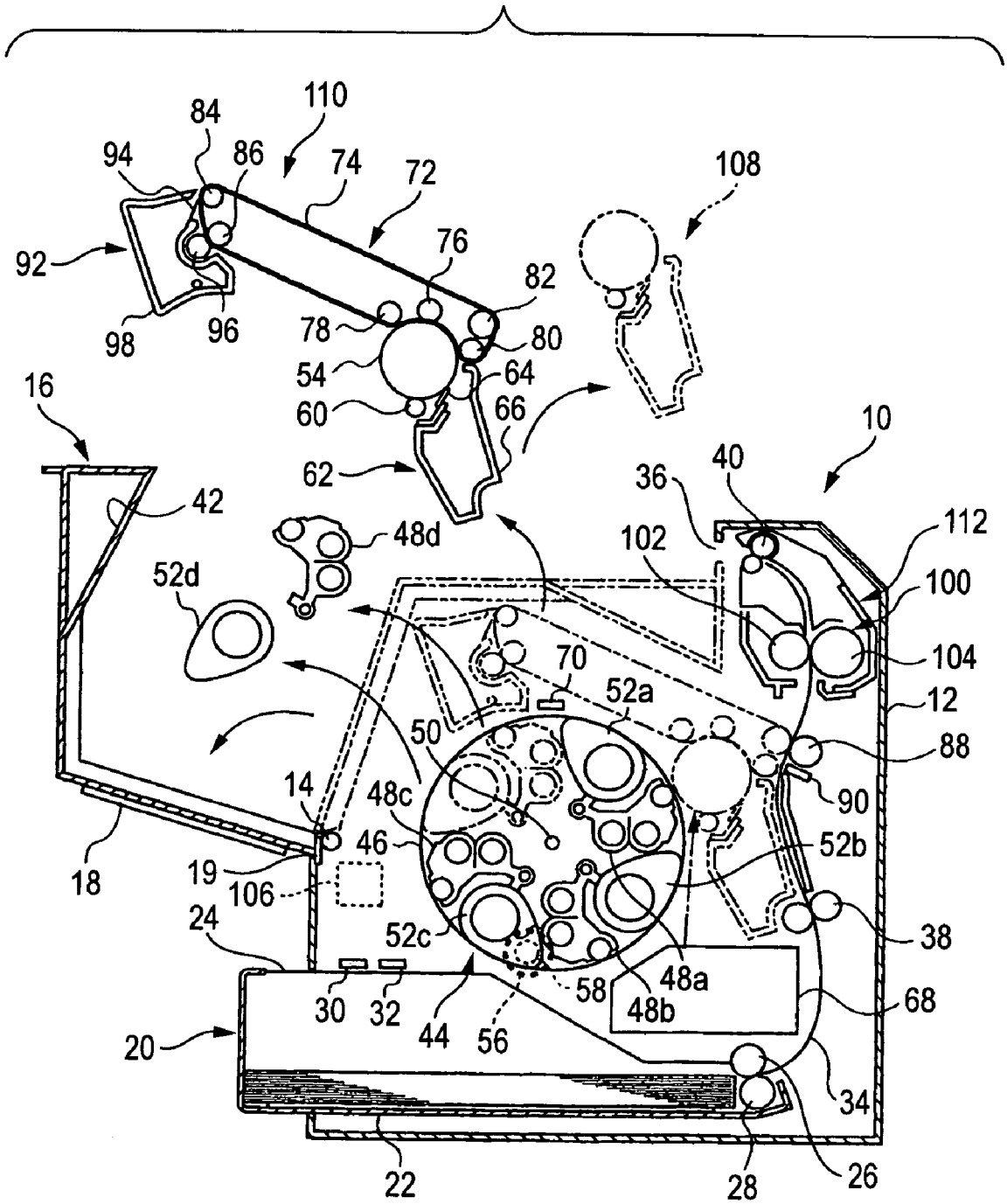
FIG. 3 is a side view illustrating a state in which an exchangeable unit of the image forming apparatus according to the embodiment of the invention is detached from a main body thereof.

As illustrated in FIG. 3, the image forming unit 110 is detachably mounted on the main body 12 of the image forming apparatus and detached therefrom by opening the opening/closing cover 16. Further, the image carrier unit 108 is detachably mounted on the image forming unit 110.

The toner cartridges 52*a* to 52*d* are adapted to be detached from the developing devices 48*a* to 48*d* mounted in the body 46 of the developing device in a case where the opening/closing cover 16 is opened and the toner cartridges 52*a* to 52*d* are positioned at the front side (that is, the side of the opening/closing cover 16). The developing devices 48*a* to 48*d* are detached from the body 46 of the developing device in a case where the opening/closing cover 16 is opened and the developing devices 48*a* to 48*d* are placed at the front side (that is, the side of the opening/closing cover 16).

The fixing unit 112 is adapted to be detached from the main body 12 of the image forming apparatus by detaching an upper cover (not shown). Further, other units, such as the developing device unit 44 and the paper feed unit 20, are detachably mounted in the main body 12 of the image forming apparatus.

Thus, each of the units can be exchanged by a user. Meanwhile, in a case where an exchangeable unit is mounted in the image forming apparatus 10 by a user, when a unit other than genuine ones produced by a manufacture of the image forming apparatus 10 is mounted therein, the following problems may occur. That is, favorable picture quality cannot be maintained. Alternatively, a proper operation cannot be ensured. This is because the image forming apparatus 10 is controlled according to the characteristics of a member used in the image forming apparatus 10. Thus, sensors for detecting predetermined conditions are provided in the units, which can be exchanged by a user.

Hereinafter, in a case where plural constituent portions, such as the developing devices 48*a* to 48*d*, are designated without being specified, abbreviations, such as "the developing device 48", may be used.

Next, an example of the exchangeable unit having a sensor for detecting predetermined conditions is described hereinbelow.

Figure 4:
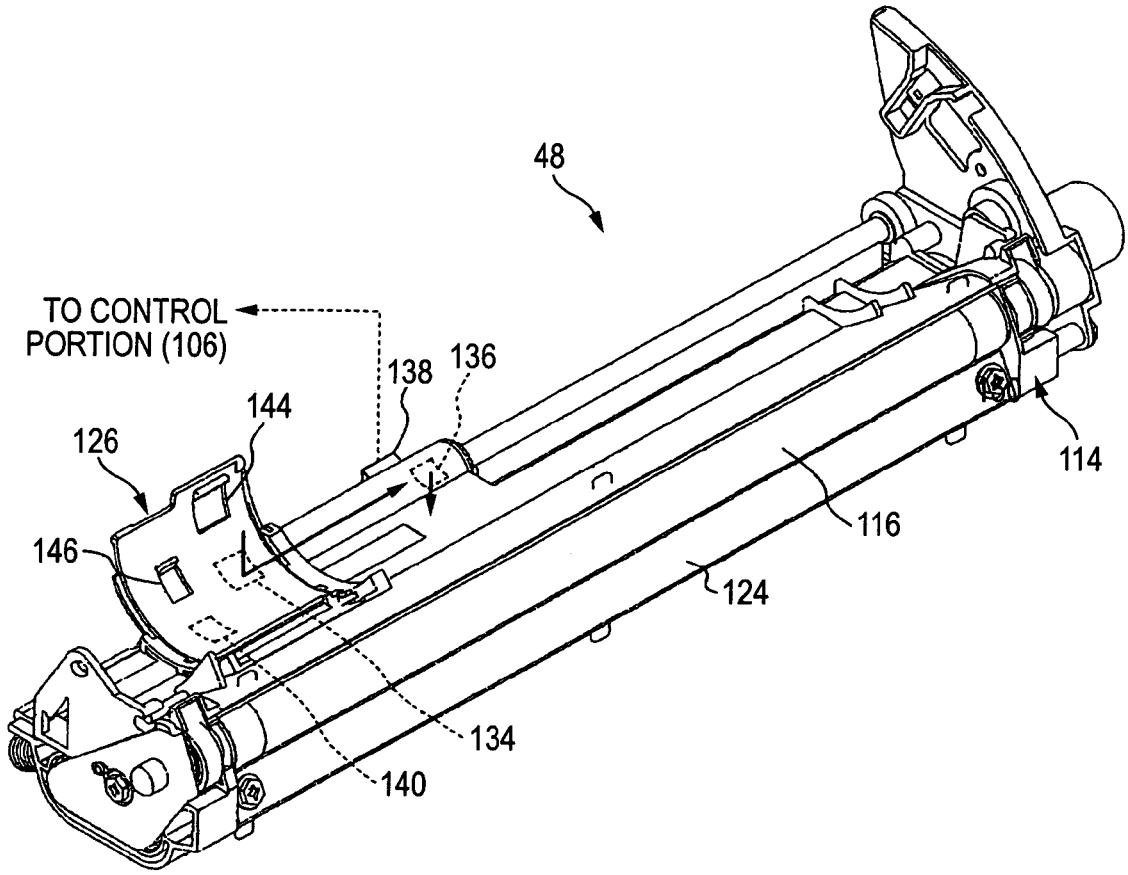
FIG. 4 is a perspective view illustrating a developing device of the image forming apparatus according to the embodiment of the invention.
Figure 5:
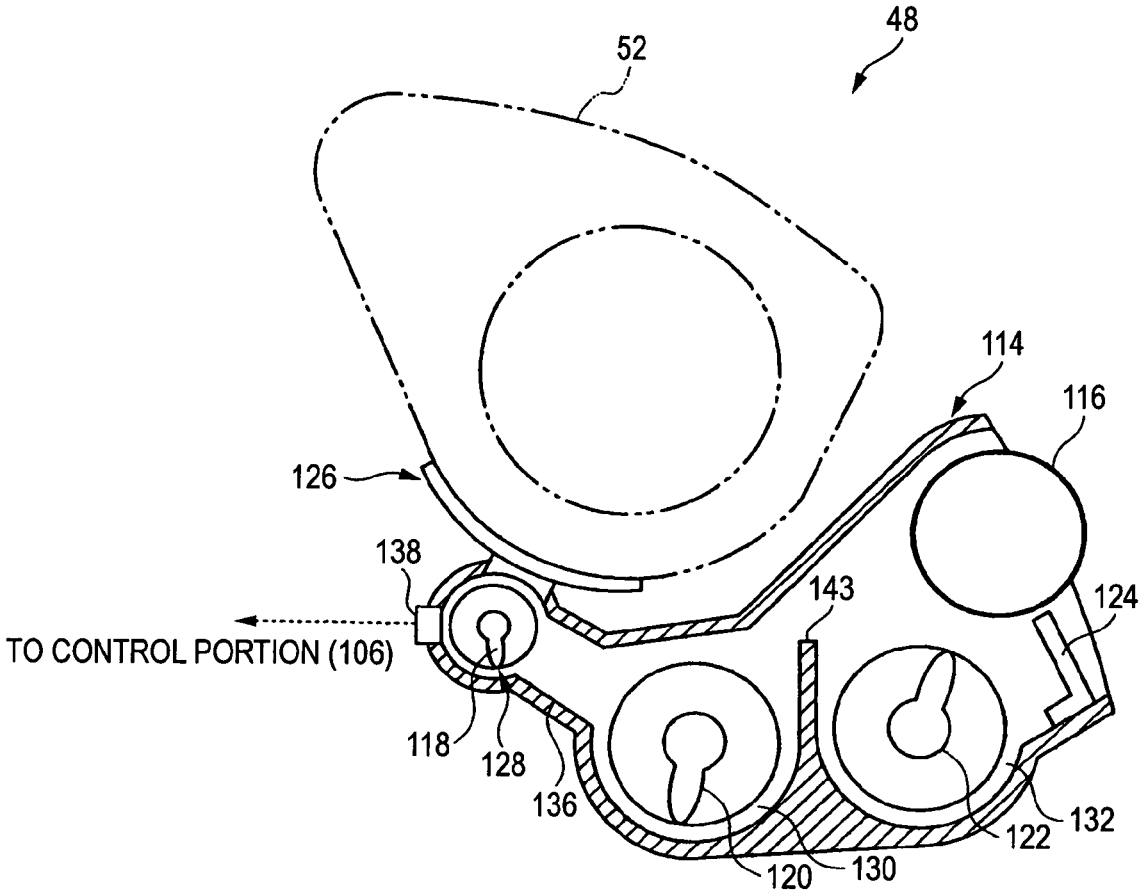
FIG. 5 is a schematic view illustrating a cross-section of the developing device of the image forming apparatus according to the embodiment of the invention.

FIGS. 4 and 5 illustrate the configuration of the developing device 48 that is an exchangeable unit.

The developing device 48 has a developing roll 116 serving as a developer carrier disposed at side of the image carrier 54 in the developing device housing (the body of the developing device) 114, and also has a first auger 118, a second auger 120, a third auger 122, and a layer thick regulating member 124, and accommodates a binary developer including, for example, non-magnetic toner and a magnetic carrier.

The developing device housing 114 has a shutter 126 for opening and closing a toner receiving port 134 and a developer discharging port 140, a cylindrical intake conveying path 128 for conveying toner taken from the toner cartridge 52, and cylindrical developer conveying paths 130 and 132 for agitating and conveying the toner and the carrier.

The intake conveying path 128 has the toner receiving portion 134 for receiving toner from the toner cartridge 52, and a toner feeding portion 136 for feeding toner to the developer conveying path 130. The first auger 118 is disposed in the intake conveying path 128. The first auger 118 is operative to convey toner, which is received from the toner cartridge 52 to the intake conveying path 128, to the developer conveying path 130. Further, the amount of toner supplied from the toner cartridge 52 to the developing device 48 is adjusted by adjusting the rotation of the first auger 118. Thus, the consumed amount of toner (that is, the consumed amount of the toner cartridge 52) may be calculated by accumulating the driving time or the number of revolutions of the first auger 118 by the use of the CPU 202. Alternatively, the consumed amount of toner may be calculated as follows. That is, electric current, which flows when an electrostatic latent image is written by the exposing device 68 to the image carrier 54, is stored in a capacitor or the like as electric charges. Then, the CPU 202 counts the number of times of occurrence of an event in which the stored charges reach a predetermined amount.

A toner presence/absence detection sensor 138 is provided between the toner receiving port 134 and the toner feeding port 136 on the intake conveying path 128. This toner presence/absence detection sensor 138 is adapted to detect the presence/absence of toner on the intake conveying path 128 by, for example, detecting change in the resistance value due to the presence/absence of toner between the two points thereon. Further, the toner presence/absence detection sensor 138 may be a piezoelectric element.

The developer conveying path 130 has a developer discharge port 140 for discharging excessive developer to the toner cartridge 52. The second auger 120 is disposed in the developer conveying path 130. The second auger 120 agitates and mixes the toner, which is conveyed through the intake conveying path 128, and the carrier and conveys the mixture to the developer conveying path 132. A toner concentration sensor 142 is provided in the developer conveying path 130. This toner concentration sensor 142 detects the concentration of toner by, for instance, detecting change in the magnetic permeability according to the concentration of toner in the developer as change in the voltage.

A third auger 122 is disposed in the developer conveying path 132. The third auger 122 is operative to agitate and convey the developer conveyed through the developer conveying path 130 and to supply the developer to the developing roll 116.

Incidentally, a partition plate 143 is provided between the developer conveying paths 130 and 132. Passages (not shown) for connecting the developer conveying paths 130 and 132 are provided at both ends of the partition plate 143. Thus, the second auger 120 and the third auger 122 convey the developer in the opposite directions. Consequently, the toner is friction-charged by the carrier in such a way as to have predetermined polarity and a predetermined amount of charge. Then, the toner is circulated in the developing device housing 114. Moreover, degraded developer is discharged from the developer discharge port 140 to the toner cartridge 52. Thus, a total lifetime of the developer can be increased (a trickle developing method).

The shutter 126 has opening portions 144 and 146. The opening portion 144 is superimposed on the toner receiving port 134 to thereby form a passage for toner from the toner cartridge 52 to the developing device 48. The opening portion 146 is superimposed on the developer discharge port 140 to thereby form a passage for excessive developer from the developing device 48 to the toner cartridge 52.

The developing roll 116 carries toner and abuts against the image carrier 54 to thereby develop an electrostatic latent image, which is carried by the image carrier 54, with the toner. The layer thickness regulating member 124 regulates the thickness of a layer of toner carried by the developing roll 116.

Figure 6:
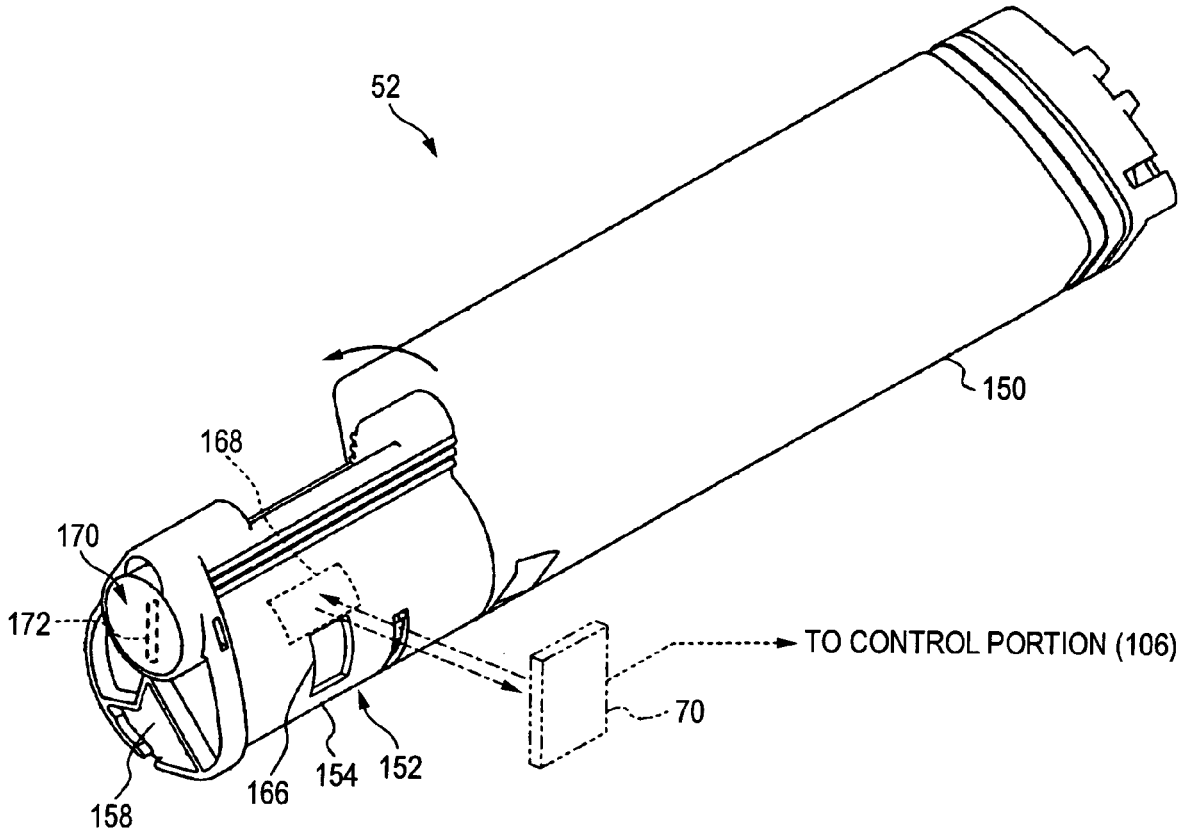
FIG. 6 is a perspective view illustrating a toner cartridge of the image forming apparatus according to the embodiment of the invention.
Figure 7:
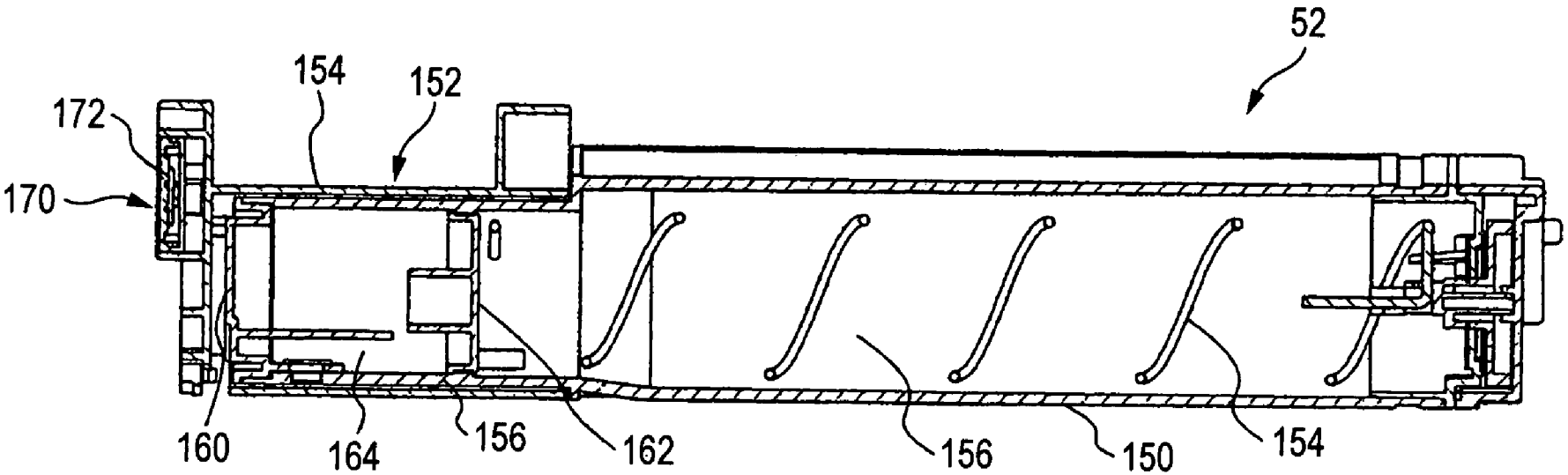
FIG. 7 is a cross-sectional view illustrating the toner cartridge of the image forming apparatus according to the embodiment of the invention.

FIGS. 6 and 7 illustrate the configuration of the toner cartridge 52, which is an exchangeable unit.

The toner cartridge 52 has a body 50 of the toner cartridge and a turning portion 152 provided at an end in the longitudinal direction of the body 150 thereof.

The body 150 of the toner cartridge is formed like a cylinder so that a substantially cylindrical portion, in which an agitating/conveying member 154 is disposed, and a portion, which extends from this substantially cylindrical portion in a substantially perpendicular direction to the longitudinal direction in such a way as to gradually reduce in width, are integral with each other. Further, the body 150 of the toner cartridge is adapted so that the outer surface thereof substantially coincides with the body 46 of the developing device unit when the toner cartridge 52 is mounted in the body 46 of the driving unit through the developing device 48.

A toner accommodating space 156 for accommodating toner to be supplied to the developing device 48 is formed in the body 150 of the toner cartridge. This agitating/conveying member 154 is wound like, for instance, a spiral, and agitates the toner in the toner accommodating space 156 and conveys this toner to the toner receiving port 134 of the developing device 48.

The turning portion 152 has a body 154 thereof and a cylinder portion 156, which is provided in this body 154 thereof and formed integrally with the body 150 of the toner cartridge. The cylinder portion 156 is adapted so that a side surface portion 158 of the body 154 of the turning portion 154 is hermetically-sealed by a sidewall thereof, and that a separation wall 162 is provided therein. A developer collection space 164 for collecting excessive developer from the developing device 48 is formed, while the toner accommodating space 156 is formed at a side opposite to the cylindrical side wall 160 by being extended.

The body 154 of the turning portion has a window-like window portion 166 covered with a transparent material. The inner part of the body 154 is formed like a cylinder and adapted to turn along the outer surface of the cylindrical part of the cylinder portion 156. Further, a reflection member, for example, white tape 168 is mounted on the outer surface of the cylindrical part of the cylinder portion 156. When the toner cartridge 52 is mounted in the developing device 48 and the body 154 of the turning portion turns, the reflection member 168 is exposed through the window portion 166. Further, when the developing device unit 44, in which the toner cartridge 52 is mounted, rotates in the main body 12 of the image forming apparatus, the exposed reflection member 168 is passed through a position opposed to the unused-state detection sensor 70. As described above, the unused-state detection sensor 70 is, for instance, the reflection type photosensor and detects an amount of reflection light from the reflection member 168, which is changed by stain due to the toner when the reflection member 168 of the toner cartridge 52 passes through the position opposed to the unused-state detection sensor 70. Consequently, the unused-state detection sensor 70 detects whether or not the toner cartridge 52 is unused.

A memory chip 170 is attached to a side surface portion 158 of the body 154 of the turning portion. The memory chip 170 has an antenna 172 and makes wireless communication with a wireless communication portion 56 provided at the side of the main body 12 of the image forming apparatus 12.

Next, the circuit configurations of the wireless communication portion 56 and the memory chip 170 and the communication performed therebetween are described hereinbelow.

Figure 8:
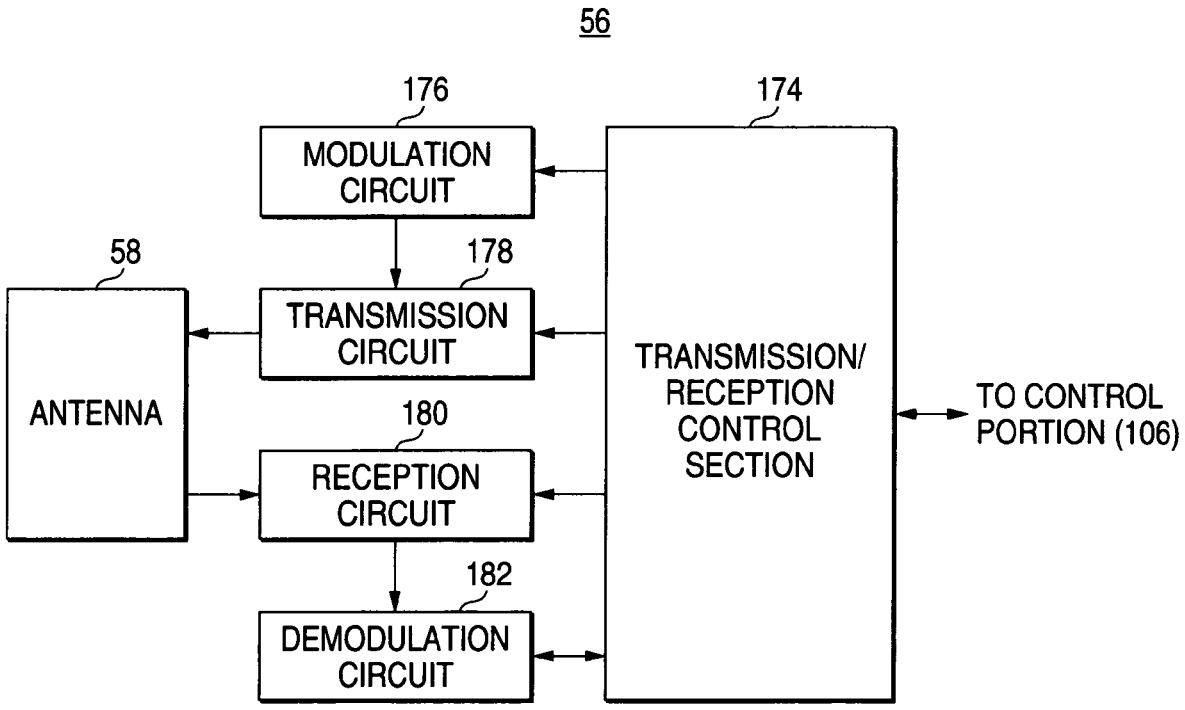
FIG. 8 is a block view illustrating the circuit configuration of a wireless communication section of the image forming apparatus according to the embodiment of the invention.
Figure 9:
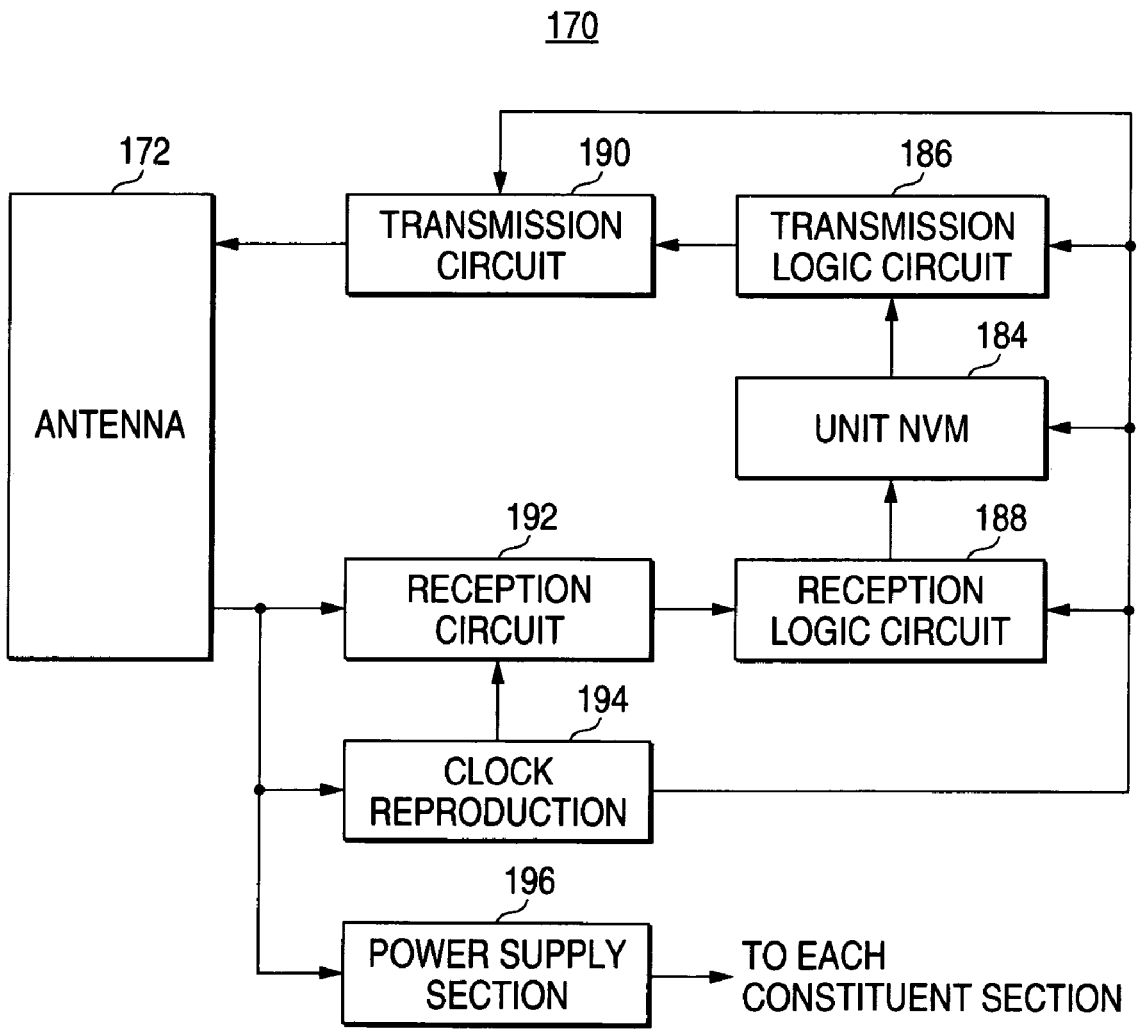
FIG. 9 is a block view illustrating the circuit configuration of a memory chip of the toner cartridge used in the image forming apparatus according to the embodiment of the invention.

FIG. 8 is a block view illustrating the circuit configuration of the wireless communication portion 56. FIG. 9 is a block view illustrating the circuit configuration of the memory chip 170.

As illustrated in FIG. 8, the circuit of the wireless communication portion 56 includes a transmission/reception control section 174, a modulation circuit 176, a transmission circuit 178, a reception circuit 180, a demodulation circuit 182, and an antenna 58. In the wireless communication portion 56, the transmission/reception control section 174 controls an operation of each of constituent portions. Further, the transmission/reception control section 174 outputs data, which is inputted from the control portion 106, to the demodulation circuit 176. Furthermore, the transmission/reception control section 174 outputs data, which is received by the reception circuit 180 and then demodulated by the demodulation circuit 182, to the control portion 106. The modulation circuit 176 modulates data inputted from the transmission/reception control section 174 and outputs modulated data to the transmission circuit 178. The transmission circuit 178 outputs electric wave signals, which include data to be stored in the memory chip 170 and clock signals, to the memory chip 170 through the antenna 58.

The reception circuit 180 receives signals transmitted from the memory chip 170 through the antenna 58 and outputs the signals to the demodulation circuit 182. The demodulation circuit 182 demodulates data transmitted from the memory 170 according to change in a signal inputted from the reception circuit 180 and outputs the demodulated data to the transmission/reception control section 174.

As illustrated in FIG. 9, the circuit of the memory chip 170 includes the unit NVM (Non-Volatile Memory) 184, a transmission logic circuit 186, a reception logic circuit 188, a transmission circuit 190, a reception circuit 192, a clock reproduction circuit 194, a power supply portion 196, and an antenna 172.

When an electric wave signal is transmitted from the wireless communication section 56 to the memory chip 170, the reception circuit 192, the clock reproduction circuit 194 and the power supply portion 196 receive this electric wave signal through the antenna 172. When the power supply section 196 receives the electric wave signal in the memory chip 170, the power supply section 196 rectifies electric current generated by electromagnetic induction due to the electric wave signal and supplies each of constituent portions of the memory chip 170 with electric power needed for an operation thereof. In a case where a voltage higher than the voltage generated by the power supply section 196 is needed, the memory chip 170 may be supplied with electric power from the body 40 thereof. For example, a coil or the like for power supply may be provided in the memory chip 170, so that electric power may be contactlessly supplied from AC power supplied to the developing device unit 44.

When receiving the electric wave signal, the clock reproduction circuit 194 reproduces a clock signal and outputs the clock signal to each of circuits constituting the memory chip 170. When receiving the electric wave signal, the reception circuit 192 outputs a signal, which represents data included by the electric wave signal to the reception logic circuit 188 in synchronization with the clock signal inputted from the clock reproduction circuit 194. The reception logic circuit 188 outputs a signal, which represents data inputted from the reception circuit 192, to the unit NVM 184 in synchronization with the clock signal inputted from the clock reproduction circuit 194.

The unit NVM 184 is a writable non-volatile memory. In a case where a signal inputted from the reception logic circuit 188 in synchronization with the clock signal inputted from the clock reproduction circuit 194 designates the writing of data, the unit NVM 184 performs the writing (or storing) of this data. In a case where the signal inputted from the reception logic circuit 188 designates the reading of data, the data stored in the unit NVM 184 is outputted to the transmission logic circuit 186. The non-volatile memory included in the unit NVM 184 may be, for example, a flash ROM, an EEPROM, or a FeRAM (ferroelectric memory).

The transmission logic circuit 186 modulates data inputted from the unit NVM 184 in synchronization with the clock signal inputted from the clock reproduction circuit 194 and outputs the modulated signal to the transmission circuit 190. The transmission circuit 190 transmits the signal, which is inputted from the transmission logic circuit 186, as an electric wave signal through the antenna 172 to the wireless communication section 56 in synchronization with the clock signal inputted from the clock reproduction circuit 194.

Incidentally, a signal to be transmitted and received as an electric wave signal may be converted into an electric wave signal after encrypted. Then, the converted signal may be transmitted and received. Alternatively, for example, the apparatus may be adapted so that an authorized user can rewrite the data stored in the unit NVM from a device other than the control portion 106.

Figure 10:
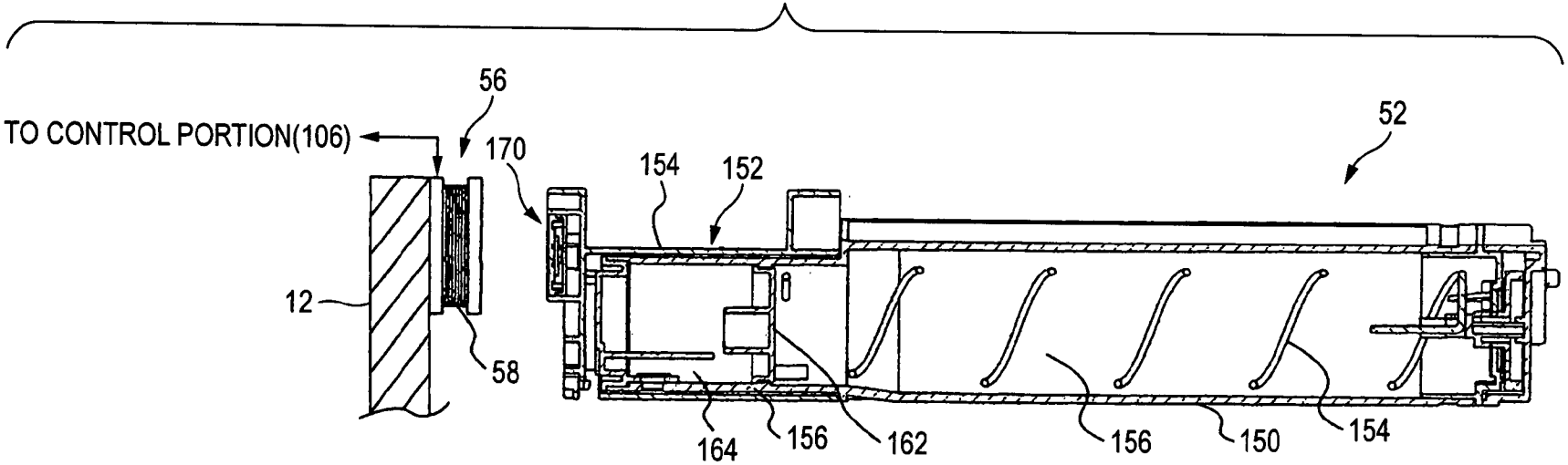
FIG. 10 is a cross-sectional view illustrating the positional relation between the wireless communication section and the memory chip, which make wireless communication with each other.

FIG. 10 illustrates the positional relation between the wireless communication portion 56 and the memory chip 170, which make wireless communication with each other. As described above, the toner cartridge 52 is mounted in each of the developing devices 48. The developing device unit 44 (FIG. 2) rotates around a rotation shaft 50 serving as an axis of rotation, so that the toner cartridge 52 moves. The wireless communication section 56 is fixed to the main body 12 of the image forming apparatus in the vicinity of the side of the developing device unit 44 in such a way as to be substantially opposed to the memory chips 170 that are moved by the rotation of the developing device unit 44. The wireless communication section 56 performs wireless communication in a stopped state in which the developing device 48 is controlled in such a way as to move a place substantially opposed thereto and as to be able to make wireless communication with one of the memory chips 170. Further, the wireless communication section 56 is adapted to confirm the start of the transmission and reception of data by receiving an acknowledge signal that is transmitted by the memory chip 170 in response to, for example, the electric wave signal outputted by the wireless communication section 56.

Figure 11:
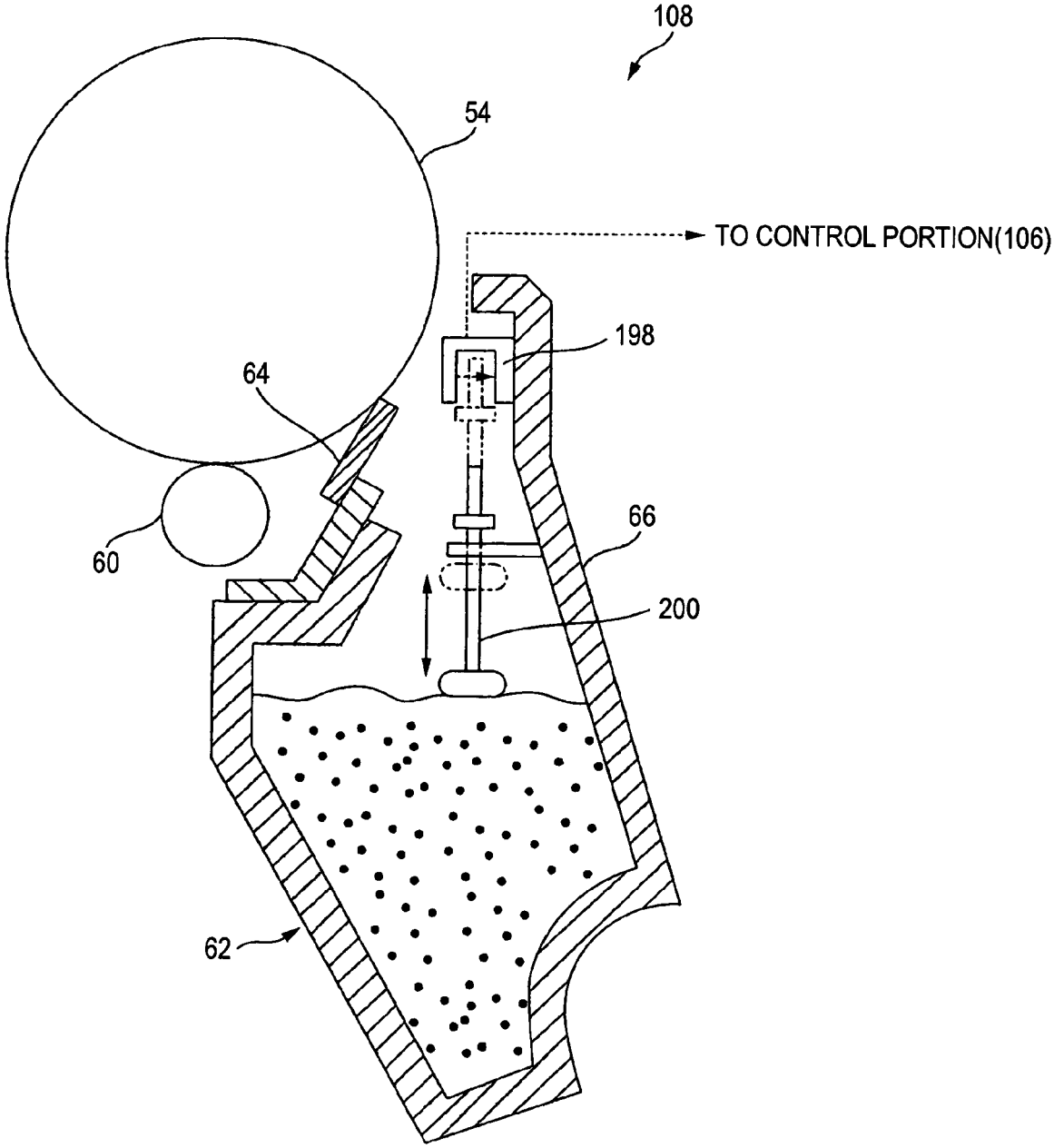
FIG. 11 is a side view illustrating the configuration of an image carrier unit used in the image forming apparatus according to the invention.

FIG. 11 illustrates the configuration of an image carrier unit 108, which is an exchangeable unit.

As described above, the image carrier unit 108 is constituted by integrating the image carrier 54, the charging device 60, and the image carrier cleaner 62. The image carrier unit 108 has a waste toner fullness sensor 198 disposed at an upper part of the image carrier cleaner 62 and also has a float 200 disposed below the waste toner fullness sensor 198. The waste toner fullness sensor 198 has an optical path adapted so that light emitted from a light emitting portion provided at one end thereof is received by a light receiving portion provided at the other end thereof. The waste toner fullness sensor 198 outputs to the control portion 106 a signal indicating whether or not the light receiving portion receives the light. The float 200 is adapted to rise when an amount of waster toner collected from the image carrier 54 to a waste toner collection bottle 66 exceeds a predetermined amount, and interrupts the optical path in the waste tone fullness sensor 198 when the waste toner collection bottle 66 is filled with waste toner to capacity thereof. Thus, the image carrier unit 108 detects by means of the waste toner fullness sensor 198 and the float 200 whether or not the waste toner collection bottle 66 is filled to the capacity thereof. Then, the image carrier unit 108 outputs a signal indicating a result of the detection.

Further, the waste toner fullness sensor 198 and the float 200 may be provided on the intermediate transfer cleaner 92 and adapted to detect whether or not the waste toner collection bottle 98 is filled to capacity thereof.

Thus, the exchangeable unit having a sensor or the like, which detects a predetermined condition, outputs to the control portion 106 a signal representing a result of detection performed by the sensor or the like. The control portion 106 is adapted to control each of the constituent sections of the image forming apparatus 10 according to the inputted result of the detection.

Next, the configuration of the control portion 106 is described in detail hereinbelow.

Figure 12:
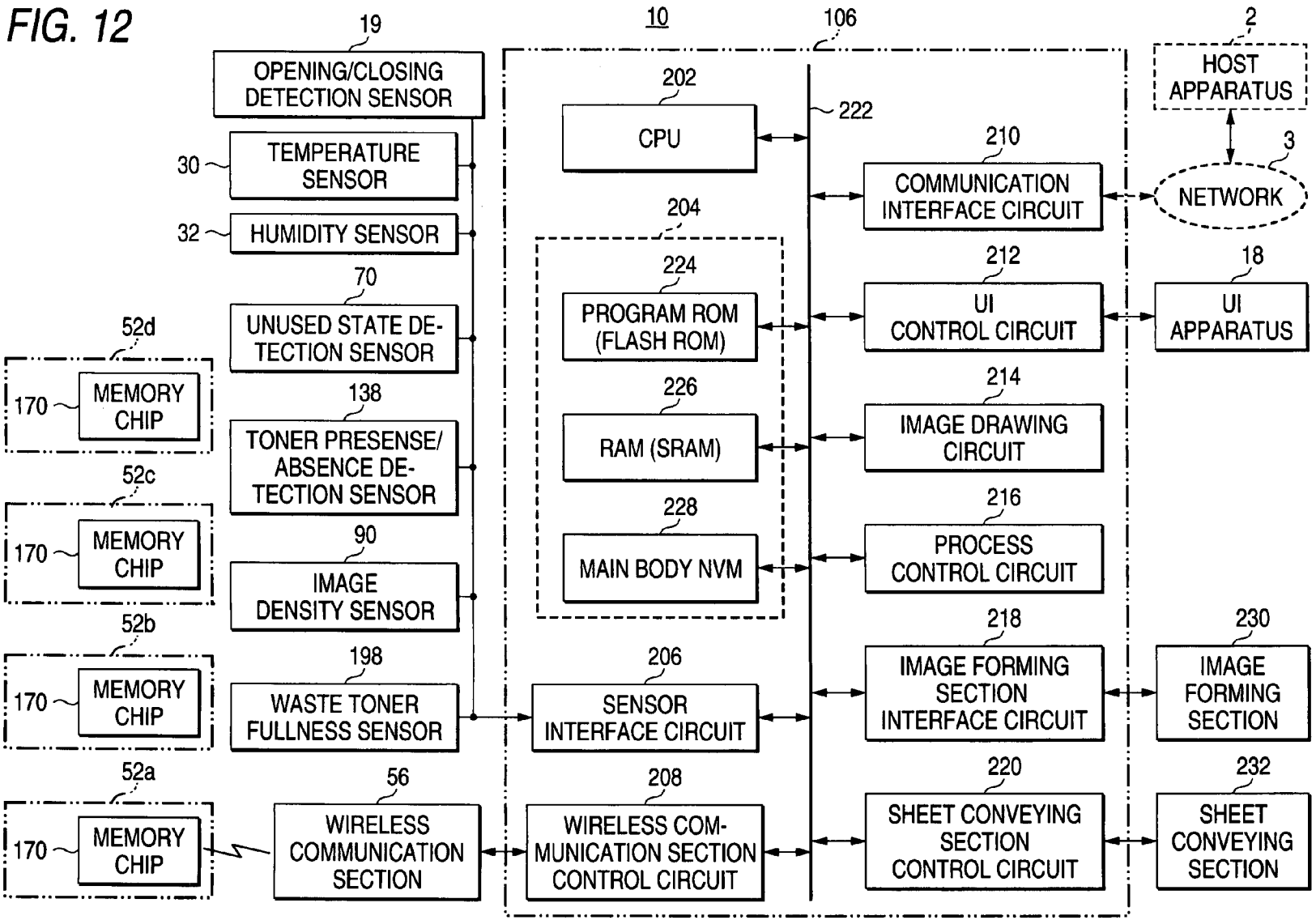
FIG. 12 is a block view illustrating the configuration of a control portion of the image forming apparatus according to the invention and also illustrating each of sections connected to the control portion.

FIG. 12 is a block view illustrating the configuration of the control portion 106 and also illustrating each of sections connected to the control portion 106.

The control portion 106 has a CPU 202, a storage section 204, a sensor interface (a sensor I/F) circuit 206, a wireless communication section control circuit 208, a communication interface (a communication I/F) circuit 210, a user interface (UI) control circuit 212, an image drawing circuit 214, a process control circuit 2126, an image forming section interface (image forming section I/F) circuit 218, and a sheet conveying section control circuit 220. These constituents are adapted to be able to input and output signals through a system bus 222.

The CPU 202 transmits signals to and receives signals from the constituents of the control portion 106 through the system bus 222 and controls the constituents of the control portion 106.

The storage section 204 has a program ROM 224, a RAM 226, and a main body NVM (Non-Volatile Memory) 228 and stores information needed for controlling the image forming apparatus 10. The program ROM 224 is constituted by, for example, a flash ROM, so that data stored therein can be updated. The RAM 226 is constituted by, for example, an SRAM, and stores temporary data, such as drawing data inputted from the image drawing circuit 214. The main body NVM 228 is constituted by, for example, an electrically rewritable non-volatile memory, such as an EEPROM or a flash ROM. Incidentally, the main body NVM 228 may be an SRAM, to which power is backed-up by a battery or the like, or a HDD (Hard Disk Drive), or an optical memory, as long as the memory is a rewritable storage and can hold data even when the power for the image forming apparatus 10 is turned off.

The sensor I/F circuit 206 receives results of detection from the opening/closing detection sensor 19, the temperature sensor 30, the humidity sensor 32, the unused-state detection sensor 70, the toner presence/absence detection sensor 138, the toner concentration sensor 142, the image density sensor 90, and the waste toner fullness sensor 198. The sensor I/F circuit 206 outputs the results to the CPU 202 through the system bus 222. The wireless communication section control circuit 208 transmits signals to and receives signals from the four memory chips 170 respectively provided at the toner cartridges 52*a* to 52*d* through the wireless communication section 56, and also transmits signals to and receives signals from the CPU 20 and the storage section 204 through the system bus 222 to thereby connect the memory chips 170, the CPU 202, and the storage section 204 to one another.

The communication I/F circuit 210 transmits signals to and receives signals from the host apparatus 2 through the network 3 and also transmits signals to and receives signals from the CPU 202 and so forth through the system bus 222 to thereby connect the host apparatus 2 and the CPU 202 to each other. The UI control circuit 212 transmits signals to and receives signals from the UI apparatus 18 and also transmits signals to and receives signals from the CPU 202 through the system bus 222 to thereby connect the UI apparatus and the CPU 202 to each other.

The image drawing circuit 214 draws an image according to an image forming signal inputted from the host apparatus 2 and so on and outputs signals to the CPU 202 and the RAM 226. The process control circuit 216 refers to set values (to be described later) stored in the storage section 204 together with the CPU 202 and controls the image forming section 230, which includes the exposing device 68, the image forming unit 110 and the developing device unit 44, through the image forming I/F circuit 218. The sheet conveying section control circuit 220 controls the sheet conveying section 232, which includes the feed roll 26, the retard roll 28, and the resist roll 38, together with the CPU 202.

Incidentally, the CPU 202 compares data, which is stored in the storage section 204, with data, which is stored in the unit NVM 184. Thus, the state of the toner cartridge 52, in which the memory chip 170 is mounted, can be determined. The memory chip 170 constitutes a part of the detection unit, even when this memory chip has no sensor.

Next, the detail of data stored in the program ROM 224, the main body NVM 228 and the unit NVM 184 are described hereinbelow.

Figure 13:
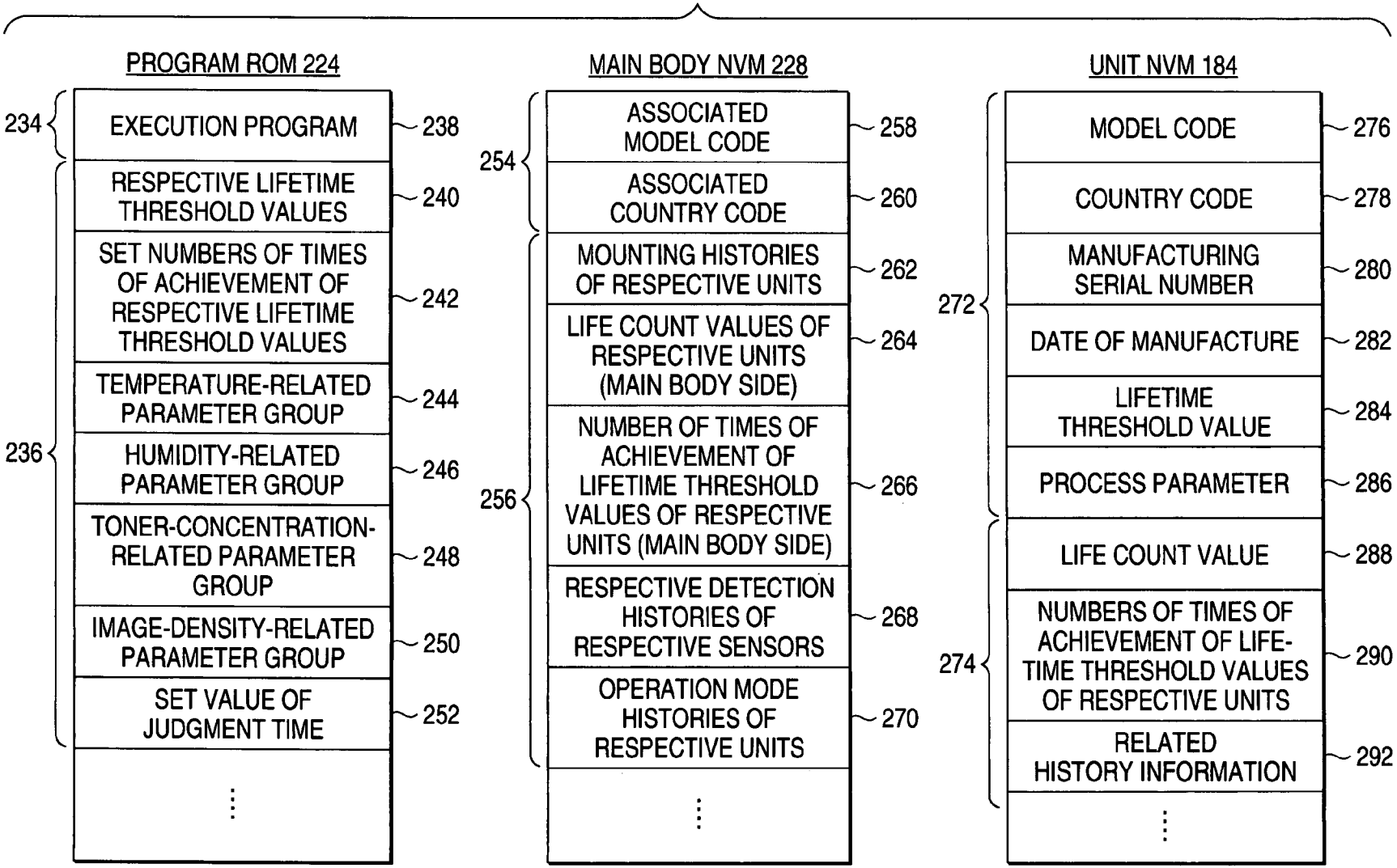
FIG. 13 is a memory map illustrating data stored in a program ROM, a main body NVM, and a unit NVM.

FIG. 13 illustrates an example of data stored in the program ROM 224, the main body NVM 228 and the unit NVM 184.

In the program ROM 224, a program area 234 and a set value area 236 are provided. In the program area 234, an execution program 238 for operating the image forming apparatus 10 is stored. In the set value area 236, respective lifetime threshold values 240, set numbers of times of achievement of respective threshold values 242, a temperature-related parameter group 244, a humidity-related parameter group 246, a toner-concentration-related parameter group 248, an image-density-related parameter group 250, and a set value of a judgment time 252 are stored.

The lifetime threshold values 240 include the values of a lifetime (the lifetime threshold values) of the respective exchangeable units of the image forming apparatuses 10. The set numbers of times of achievement of the respective threshold values 242 include the numbers of times at which the exchangeable units of the image forming apparatus 10 can reach the lifetime threshold values. The temperature-related temperature parameter group 244 includes the respective parameters concerning the control of temperature of the image forming apparatus 10. The humidity-related temperature parameter group 246 includes the respective parameters concerning the control of humidity of the image forming apparatus 10. The toner concentration parameter group 248 includes the respective parameters concerning the control of the toner concentration in the developing device 48. The image density parameter group 250 includes the respective parameters concerning the control of density of an image formed on the intermediate transfer member 74. The set value of the judgment time 252 includes that of a time period (a judgment time) required by the CPU 202 to start judgment on whether or not each of the exchangeable units of the image forming apparatus 10 is a genuine unit.

In the main body NVM 228, an associated unit information area 254 and a main body side update area 256 are provided.

In the associated unit information area 254, an associated model code 258 and an associated country code 260 are stored. An area for the associated model code 258 stores a model table (or data) indicating models that are compatible with the image forming apparatus 10. An area for the associated country code 260 stores a country table (or data) representing countries, which are associated with and have different specifications set for each of the exchangeable units of the image forming apparatus 10.

In the main body side update area 256, the mounting histories of the units 262, the main-body-side life count values thereof 264, the numbers of times of achievement of threshold values thereof 266, the detection histories thereof 268, and the operation mode histories thereof 270 are stored. The mounting histories 262 of the units include those of the exchangeable units of the image forming apparatus 10. Further, it is stored as the initial states (or the initial values) of the mounting histories 262 of the units that a genuine one is mounted therein. The main-body-side life count values thereof 264 include the life count values (that is, consumed amounts from the commencement of use to a current time) of the respective units. Incidentally, the consumed amount of each of the units may be calculated according to the accumulated operation time thereof. The numbers 266 of times of achievement of lifetime threshold values at the main body side include the numbers of times of achievement of lifetime threshold values of the respective exchangeable units. The detection histories 268 include the histories of detection results detected by the sensors provided in the image forming apparatus 10. The operation mode histories 270 include the operation mode histories applied to the respective exchangeable units.

A unit information area 272 and a unit-side update area 274 and so on are provided in the unit NVM184.

The unit information area 272 stores a mode code 276 representing the model thereof, a country code 278 representing a country in which the specification is set, a manufacturing serial number 280 unique thereto, a date 282 of manufacture thereof, a lifetime threshold value 284 representing the lifetime thereof, and a process parameter 286 for process control, and so on.

The unit-side update area 274 stores a life count value 288 representing a consumed amount of the toner cartridge from the commencement of use thereof to the current time, the number 290 of times of achievement of the lifetime threshold value of each of the units, which represents the number of times of occurrences of an event that the associated unit reaches the lifetime threshold value, and related history information 292, and so forth. Incidentally, the related history information 292 includes history of related information, such as the number of revolutions of the image carrier 54, which is available for grasping the situation of the toner cartridge 52.

The image forming apparatus 10 of the aforementioned configuration is adapted so that when an image forming signal is sent thereto, the image carrier 54 is uniformly charged by the charging device 60, that light rays are outputted from the exposing device 68 to this charged image carrier 54 according to an image signal, and that the light rays outputted from the exposing device 68 exposes the surface of the image carrier 54 to thereby form a latent image.

The latent image carried by the image carrier 54 is developed by the developing device unit 44 at a developing position. In the developing device unit 44, the developing devices 48*a* to 48*d* are supplied with yellow toner, magenta toner, cyan toner, and black toner from the toner cartridges 52*a* to 52*d*, respectively. Further, developers excessively supplied to the developing devices 48*a* to 48*d* are collected by the toner cartridges 52*a* to 52*d*, respectively. Toner images respectively corresponding to colors developed by the developing devices 48*a* to 48*d* of the developing device unit 44 are primary-transferred onto the intermediate transfer member 47 by being superimposed. Waste toner left on the image carrier 54 by the first transfer is raked out by the image carrier cleaner 62 and collected.

Meanwhile, a sheet of paper accommodated in the paper feed cassette 24 is fed by the feed roll 26 in response to a paper feeding signal or the like. Then, the sheets of paper are handled by the retard roll 28 thereby to be led to the conveying path 34. Subsequently, the sheet of paper is temporarily stopped by the resist roll 38. Then, the sheet of paper is led between the secondary transfer roll 88 and the secondary transfer backup roll 82 with appropriate timing. When the sheet of paper is introduced between the secondary transfer roll 88 and the secondary transfer backup roll 82, the four color toner images superimposed by the primary-transfer are secondary-transferred to the sheet of paper by the secondary transfer roll 88 and the secondary transfer backup roll 82. After the secondary transfer, the waste toner left on the intermediate transfer member 74 is raked out by the intermediate transfer member cleaner 92 and collected.

The sheet of paper, to which the toner images are transferred, is introduced to the fixing device 100, and then fixed by a thermal pressure due to the heating roll 102 and the pressure roll 104. The sheet of paper, on which the toner images are fixed, is discharged by the discharge roll 40 from the discharge port 36 to the discharge portion 42. The control portion 106 causes the unit NVM 184 and the main body NVM 228 to store the life count values of the toner cartridge 52 and so on.

Figure 14:
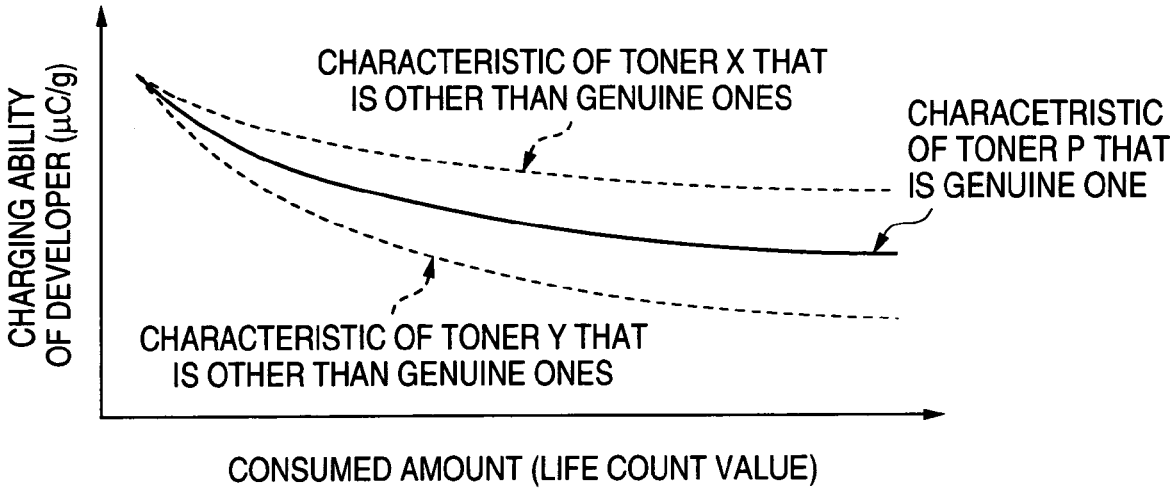
FIG. 14 is a graph illustrating change in the charging ability of a developer versus a consumed amount (a life count value) stored in the main body NVM.

FIG. 14 is a graph illustrating change in the charging ability of the developer versus the consumed amount (the life count value) stored in the main body NVM.

Figure 15:
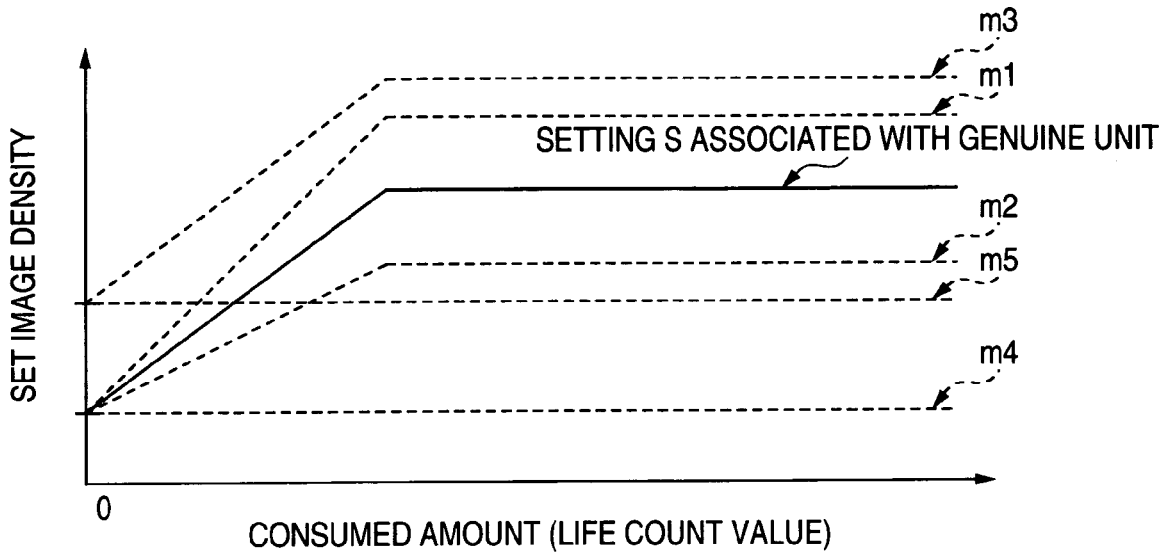
FIG. 15 is a graph illustrating the setting for correcting change in the charging ability of the developer and also illustrating the setting of the image density versus the consumed amount of the developer.

FIG. 15 is a graph illustrating the setting for correcting the change in the charging ability of the developer and also illustrating the setting of the image density versus the consumed amount of the developer.

Figure 16A:
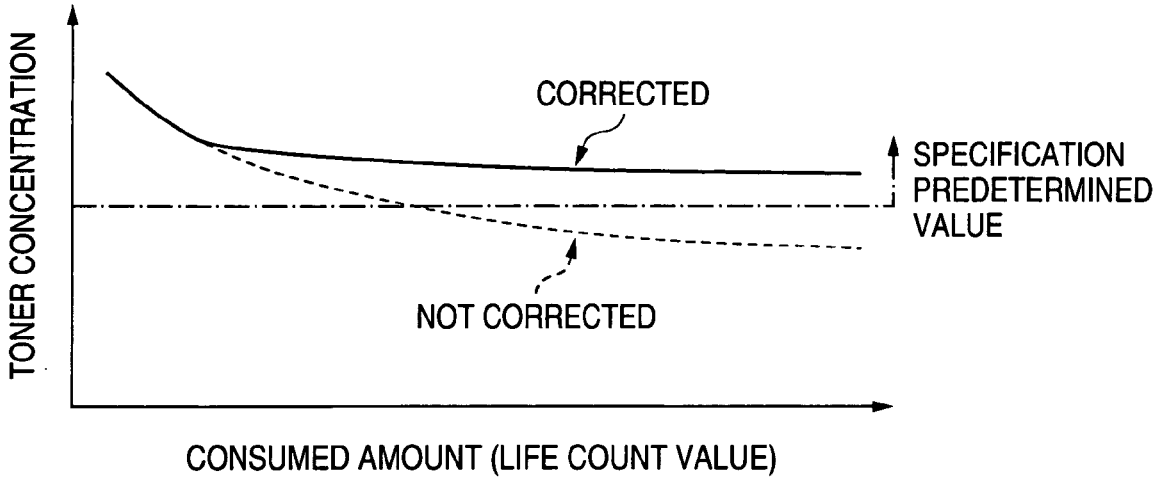
FIGS. 16A and 16B are graphs illustrating results of correction performed according to the setting illustrated in FIG. 15.
Figure 16B:
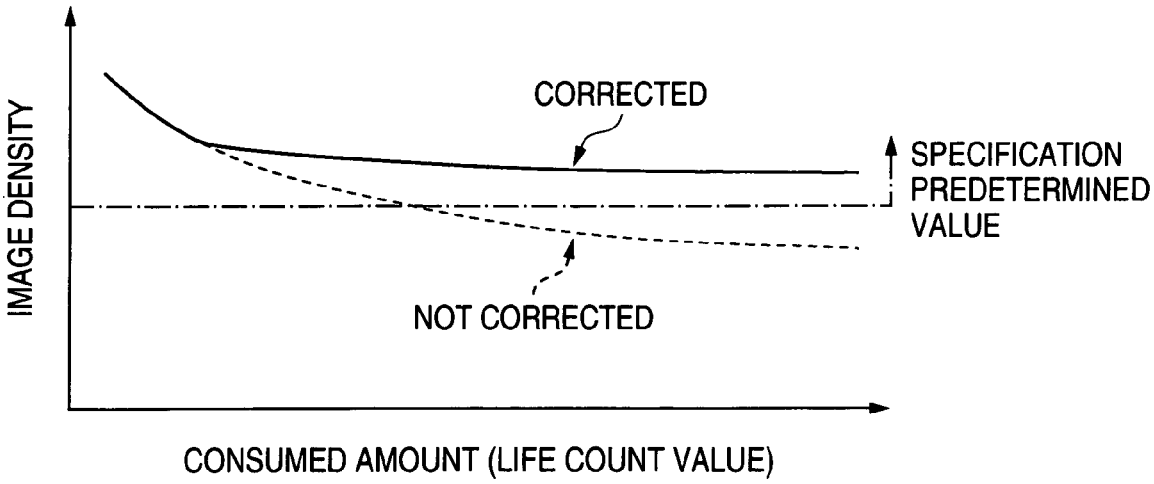

FIGS. 16A and 16B are graphs illustrating results of correction performed according to the setting illustrated in FIG. 15. FIG. 16A illustrates the corrected toner concentration. FIG. 16B is a graph illustrating the corrected image density.

The toner, which is accommodated in the toner cartridge 52 and a genuine toner for the image forming apparatus 10, is friction-charged by the carrier in such a way as to have predetermined polarity and a predetermined amount of charge. When the developer is used, the charging ability thereof is lowered according to the consumed amount thereof, as the characteristic of toner P, which is genuine toner, changes shown in FIG. 14.

Thus, even when employing a trickle developing method, the image forming apparatus 10 is adapted to correct the setting of the concentration of toner in the developing device 48 and that of the density of an image formed on the intermediate transfer member 74 so as to maintain the picture quality of an image formed on paper.

For example, the CPU 202 detects an image density by the image density sensor 90. If the density is high, the CPU 202 controls rotation driving of the first auger 118 to thereby reduce the amount of toner supplied to the developing device 48, so that the toner concentration is decreased, and that the image density is lowered. Conversely, if the density is lowered, the CPU 202 controls rotation driving of the first auger 118 to thereby increase the amount of toner supplied to the developing device 48, so that the toner concentration is increased, and that the image density is raised. Usually, a pattern having a halftone density is used as a pattern for detecting the image density.

However, if the charging ability of toner is lowered, the developing performance is enhanced, so that the image density rises. Therefore, if the aforementioned control is performed without being modified, the toner concentration is excessively lowered to thereby lower the maximum image density.

Thus, the CPU 202 corrects the set value used for toner concentration control, which is based on the result of the image density detection by the image density sensor 90 and stored in an area for the toner concentration parameter group 248 and set in the developing device 48, in such a way as to increase according to the consumed amount of the developer so as not to reduce the maximum density of an image, which is to be transferred on to paper, from being lowered even when the charging ability of the developer is degraded. The CPU 202 rotates the first auger 118 according to the corrected set value (in accordance with the setting S associated with the toner P as shown in FIG. 15) thereby to maintain the toner concentration in such a manner as not to become less than a desired and predetermined value, as illustrated in FIG. 16A.

Consequently, the image density can be maintained in such a way as not to become equal to or less than a value predetermined according to the specification, as illustrated in FIG. 16B.

Meanwhile, in a case where a toner cartridge, which is other than genuine ones and has substantially the same configuration as that of the toner cartridge 52 accommodating the toner X or Y that is other than genuine toner produced by an original manufacturer of the image forming apparatus 10, is mounted therein, the toner X or Y exhibits a characteristic differing from the characteristic of the toner P, which is genuine, as illustrated in FIG. 14. Therefore, a set value, which is corrected and differs from the value set according to the setting S associated with the toner P is necessary for improving the picture quality of an image formed on the paper. Thus, for example, in a case where the toner cartridge accommodates toner X or toner Y and is other than genuine ones, a correction made to the consumed amount of the developer is changed according to the combination of the following change conditions:

an amount (or gradient) of change in the set value of the toner concentration is increased or decreased (m1, m2 in FIG. 15);

a limit value is increased or decreased (m1, m2);

an initial value (the consumed amount=0) is changed (m3);

the set value according to the consumed amount is not changed (m4); and the set value according to the consumed amount is not changed by changing, for example, the initial value. This change is performed by the user's selection of an operation mode through the UI apparatus 18 as an operation mode differing from a mode corresponding to the genuine one.

Next, control according to an environment of the image forming apparatus 10 is described hereinbelow.

Figure 17:
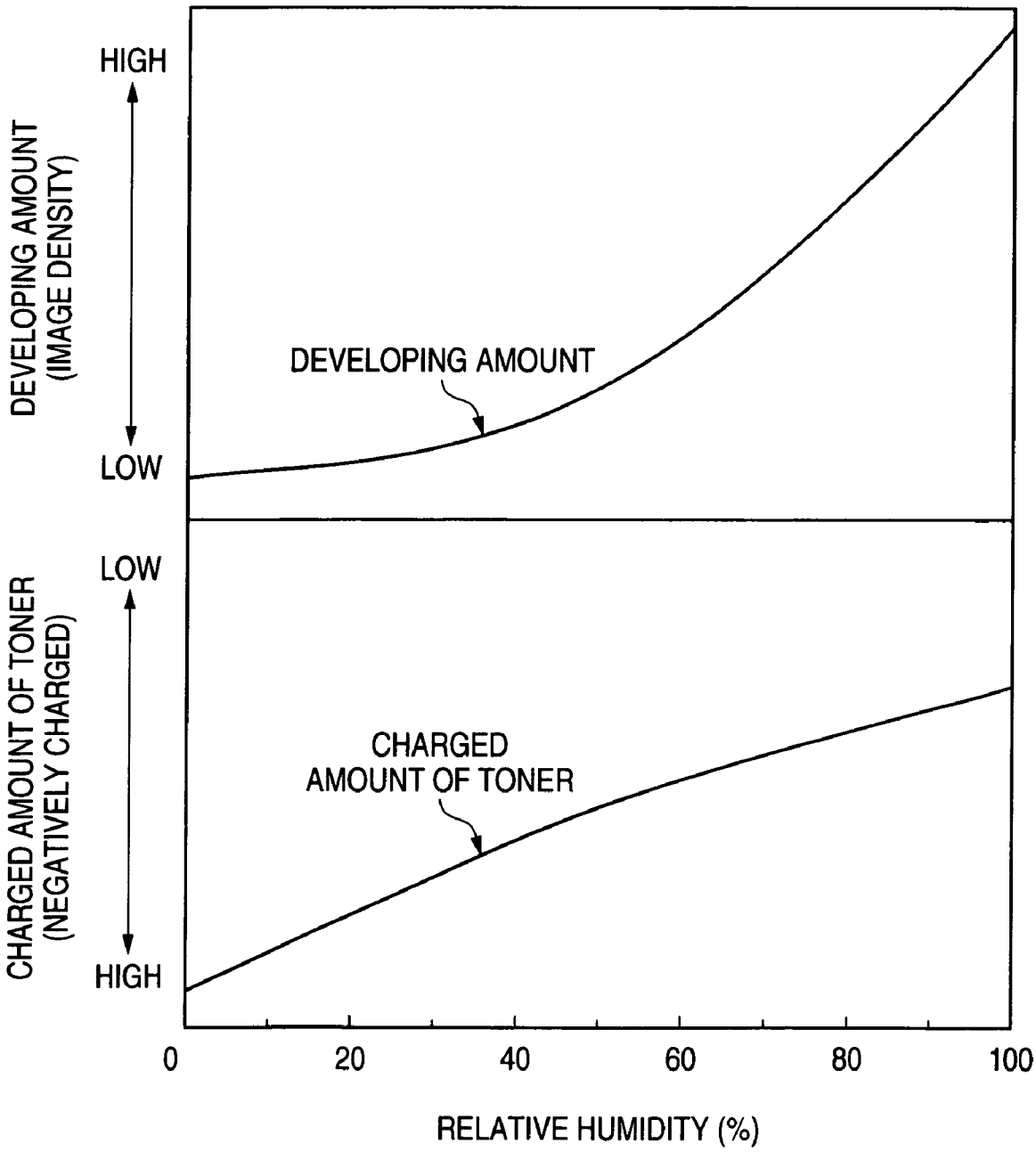
FIG. 17 is a graph illustrating change in the charged amount of a toner A, which is a genuine one, and change in the developing amount (or image density) thereof versus change in the (relative) humidity thereof.

FIG. 17 illustrates change in the charged amount of a toner A, which is a genuine one, and change in the developing amount (or image density) thereof versus change in the humidity (that is, the relative humidity) thereof. In a case where the toner concentration is constant, the charged amount of the toner, which is a two-component developer accommodated in the developing device 48, changes when environmental conditions, such as humidity and temperature, change. For instance, when the humidity rises, an amount of water absorption of the toner increases, while the charged amount of the toner decreases (in a case where the toner is negatively charged, the absolute value of a negative value thereof decreases). When the charged amount of the toner decreases, the electrostatic adsorbing force acting between toner and the carrier is reduced, so that an amount of the developer (that is, the developing amount thereof) transferred to the electrostatic latent image on the image carrier 54 increases, and that the density of a toner image (that is, the image density thereof) carried by the intermediate transfer member 74 becomes high. Meanwhile, when the humidity becomes low, the amount of water absorption of the toner decreases, and the charged amount of the toner increases (in the case where the toner is negatively charged, the absolute value of a negative value thereof increases). When the charged amount of the toner increases, the electrostatic adsorbing force acting between the toner and the carrier is strengthened. The amount of the developer transferred to the electrostatic latent image on the image carrier 54 decreases, so that the density of the toner image carried by the intermediate transfer member 74 becomes low.

To maintain the density of an image, which is formed on the paper, at a predetermined level, the image forming apparatus 10 is adapted so that plural control operations according to the characteristics of constituent portions of the image forming apparatus 10 are performed by the control portion 106. For example, the image forming apparatus 10 is adapted so that the image density sensor 90 detects the concentration of the patch of the toner, which is formed on the intermediate transfer member 74, that a charged amount of the toner in the developing device 48 is maintained according to a result of the detection by the image density sensor 90, that the CPU 202 of the control portion 106 controls the rotation of the first auger 118 in such a way as to maintain the concentration of the patch to thereby adjust the amount of the toner to be supplied to the developing device 48 (a control function performed by feedback of the result of the detection by the image density: an image density control).

Figure 18:
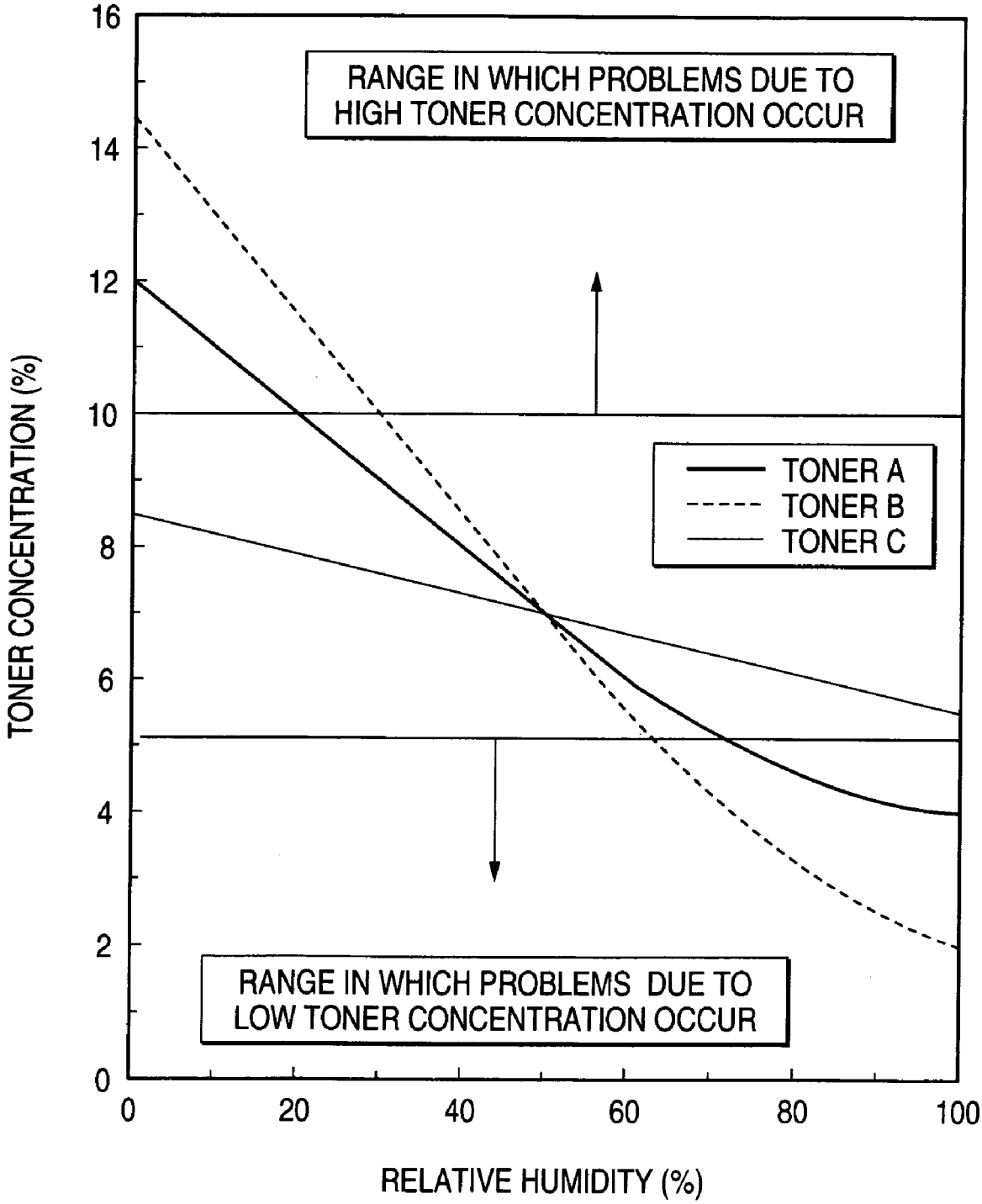
FIG. 18 is a graph illustrating the humidity characteristic of the toner concentration adjusted by an image density control.

FIG. 18 is a graph illustrating the humidity characteristic of the toner concentration adjusted by the image density control. As described above, when the (relative) humidity is low, the charged amount of the toner becomes high, while the density of an image formed on the intermediate transfer member 74 becomes low. When the density of the image formed on the intermediate transfer member 74 becomes low, the CPU 202 increases the amount of the toner to be supplied to the developing device 48 by the control according to which the result of the detection of the image density is fed back to the determination of the toner concentration. Thus, when the humidity is low, the toner concentration is high. Meanwhile, when the (relative) humidity is high, the charged amount of the toner is low, while the density of an image formed on the intermediate transfer member 74 becomes high. When the density of the image formed on the intermediate transfer member 74 becomes high, the CPU 202 reduces the amount of the toner to be supplied to the developing device 48 by the control according to which the result of the detection of the image density is fed back to the determination of the toner concentration. Thus, when the humidity is high, the toner concentration is high.

When the humidity becomes less than about 20%, the toner A, which is a genuine one, causes problems due to a high toner concentration, such as a problem in that the toner A scatters in the main body 12 of the image forming apparatus, so that the inside of the main body 12 thereof is stained. Further, when the humidity becomes higher than about 70%, the toner A causes problems due to a low toner concentration, such as a problem in that the efficiency in transferring an image is reduced.

The concentration of a toner B, which is other than genuine ones, changes more by the control, according to which the result of the detection of the image density is fed back to the determination of the toner concentration, more largely than that of the toner A. Even when the concentration of a toner C, which is other than genuine ones, changes by the control, according to which the result of the detection of the image density is fed back to the determination of the toner concentration, the toner C causes no problems due to the toner concentration. Incidentally, a nongenuine toner is used as the toner C because of the facts that problems due to the toner concentration are not caused, and that the cleanability of the residual toner on the image carrier 54 is less than that of the toner A.

Figure 19:
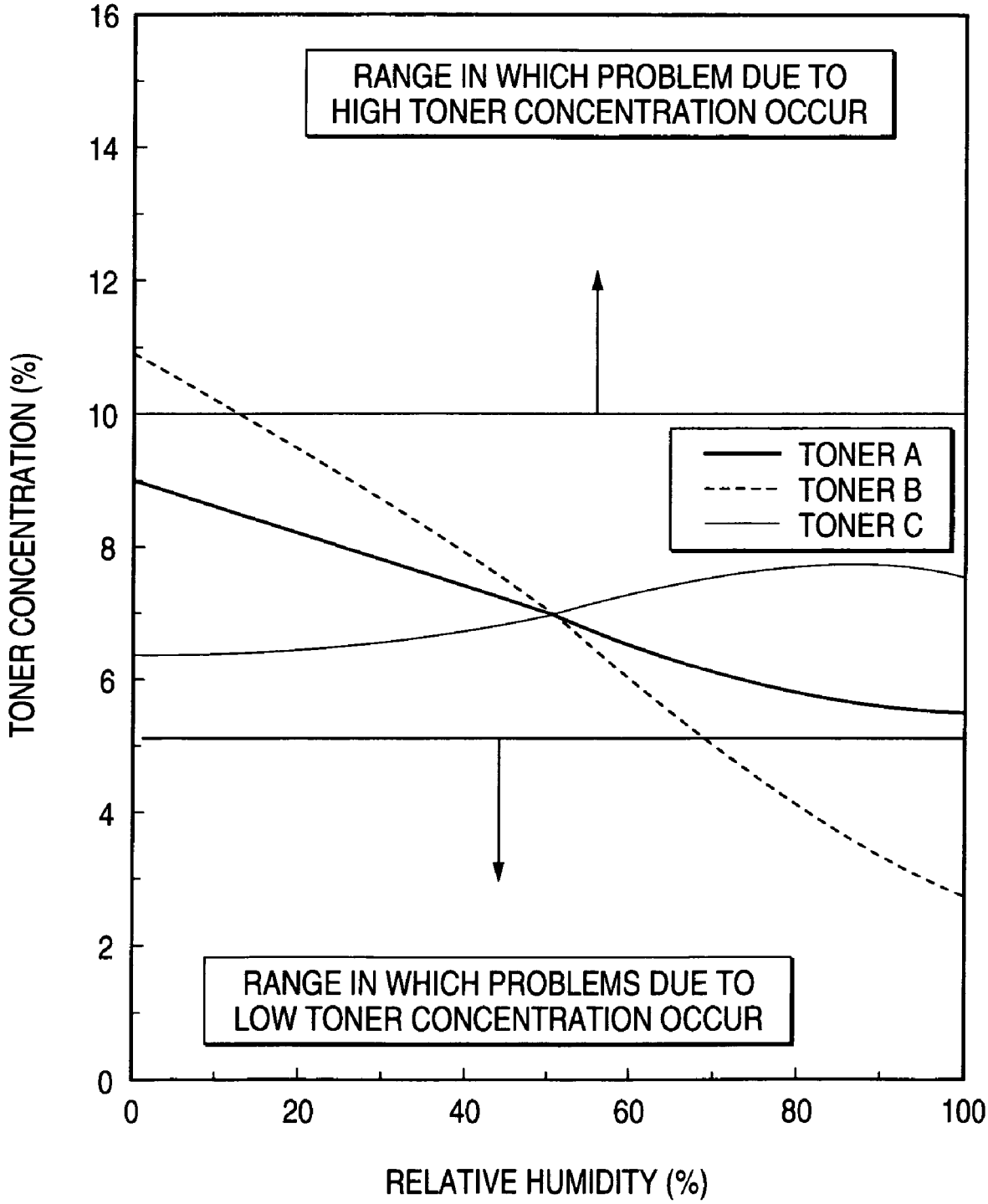
FIG. 19 is a graph illustrating toner concentrations of toners A, B, and C versus the (relative) humidity thereof in the case of performing the image density control corrected in a default mode.

FIG. 19 shows the toner concentrations of the toners A, B, and C versus the (relative) humidity thereof in the case of performing the image density control corrected in a default mode.

When the default mode is selected for the toner A, the toner concentration thereof changes with the humidity thereof in a range in which the change in the concentration thereof causes no problems. Even when the default mode is selected for the toner B, the change in the toner concentration of the toner B for the humidity thereof is set within a range in which the change in the toner concentration thereof causes no problems. Further, when the default mode is selected for the toner C, the concentration of the toner C becomes high in the case of high humidity, while that of the toner C becomes low in the case of low humidity. Thus, in a certain range, the change in the toner concentration for the change in the humidity becomes large, so that the adjustment of the concentration thereof is needed.

As described above, the control parameter associated with the genuine toner is set as the initial value. Thus, in the case where the exchange unit is a genuine one, no problems occur in the default mode. However, in the case where the exchange unit is other than genuine ones, it is necessary to change the control parameters of the control parameter groups 244 to 250 in such a way as to correspond to the nongenuine unit.

Figure 20:
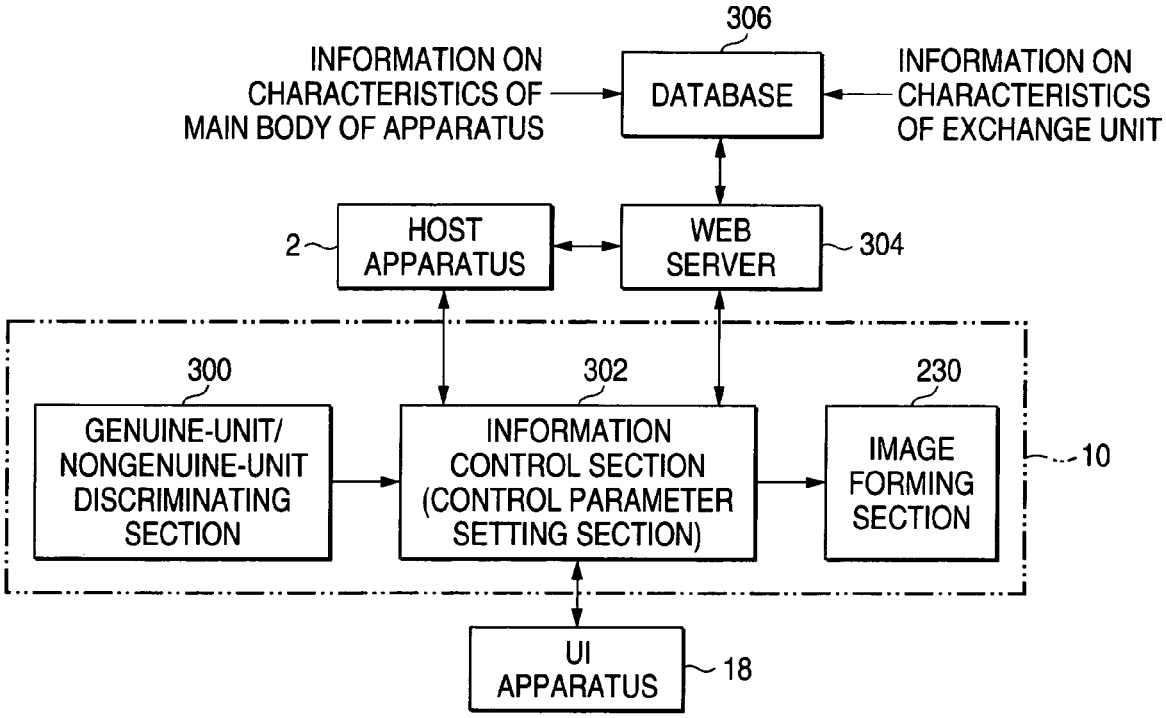
FIG. 20 is a block view illustrating the entire image forming system enabled to adjust control parameters.

FIG. 20 is a block view illustrating the entire image forming system enabled to adjust the control parameters.

The image forming apparatus 10 has a genuine-unit/nongenuine-unit discriminating section 300, which is implemented by the execution program 238 stored in the program ROM 224, for discriminating whether or not the exchange unit is a genuine one. Whether or not the exchange unit is a genuine one is judged, for example, according to the following plural kinds of information (1) to (5):

(1) User's Inputted Information

In a case where information, which represents whether or not the exchange unit is a genuine one, can be inputted from the aforementioned host apparatus 2 or the UI apparatus (that is, an operation panel) 18 of the image forming apparatus 10, it is determined according to the inputted information whether or not the exchange unit is a genuine one.

(2) The Presence/Absence of Memory Chip

Although a genuine unit has a memory chip 170, some nongenuine unit does not have the memory chip 170. Thus, in a case where even when the wireless communication section 56 requests a response, the exchange unit offers no response, it is judged that the exchange unit is other than genuine ones.

(3) Code Information

The model code 276, the country code 278 and so on of the unit NVM 184 are compared with the associated model code 258, the associated country code 260 and so forth, respectively. Then, it is judged whether or not there is a match between the codes 276, 278 and the associated codes 258, 260. This judgment may be performed in a case where there is a certain allowable range of the match therebetween (that is, in cases that the model code is similar to the associated one, and that the country code is similar to the associated one), in addition to the case of a complete match therebetween.

(4) Consumed Amount

In a case where the life count value of the memory chip 170 exceeds, for instance, the lifetime threshold value of the program ROM 224, it can be judged that the exchange unit is other than genuine ones.

(5) Detection of Control State

As described above, the genuine unit and the nongenuine unit may differ from each other in the charging characteristic of the toner according to the consumed amount thereof. Thus, even in a case where the toner concentration does not reach a predetermined even when a predetermined correction is performed, it can be judged that a nongenuine unit is mounted.

Further, the area for the execution program 238 has an information control section (a control parameter setting section) 302 for controlling whether or not information is printed on paper. This information control section 302 is used for setting control parameters. The control parameters can be inputted from a Web server 304 through the UI apparatus 18, the host apparatus 2, or the Internet. The image forming section 230 is controlled and images are printed on paper according to the control parameters set in this information control section 302.

The Web server 304 is enabled to also intercommunicate with the host apparatus 2 through the Internet. Further, this Web server 304 can exchange information with a database 306. This database 306 stores information on the main body of the apparatus (for example, information on fixing temperature characteristics, transfer bias characteristics and so on), which is inputted from the manufacturer thereof. Also, the database 306 stores information on the exchange unit (for instance, information on the humidity characteristic and the temperature characteristic and so on of the toner), which is inputted from the maker of the exchange unit.

Figure 21:
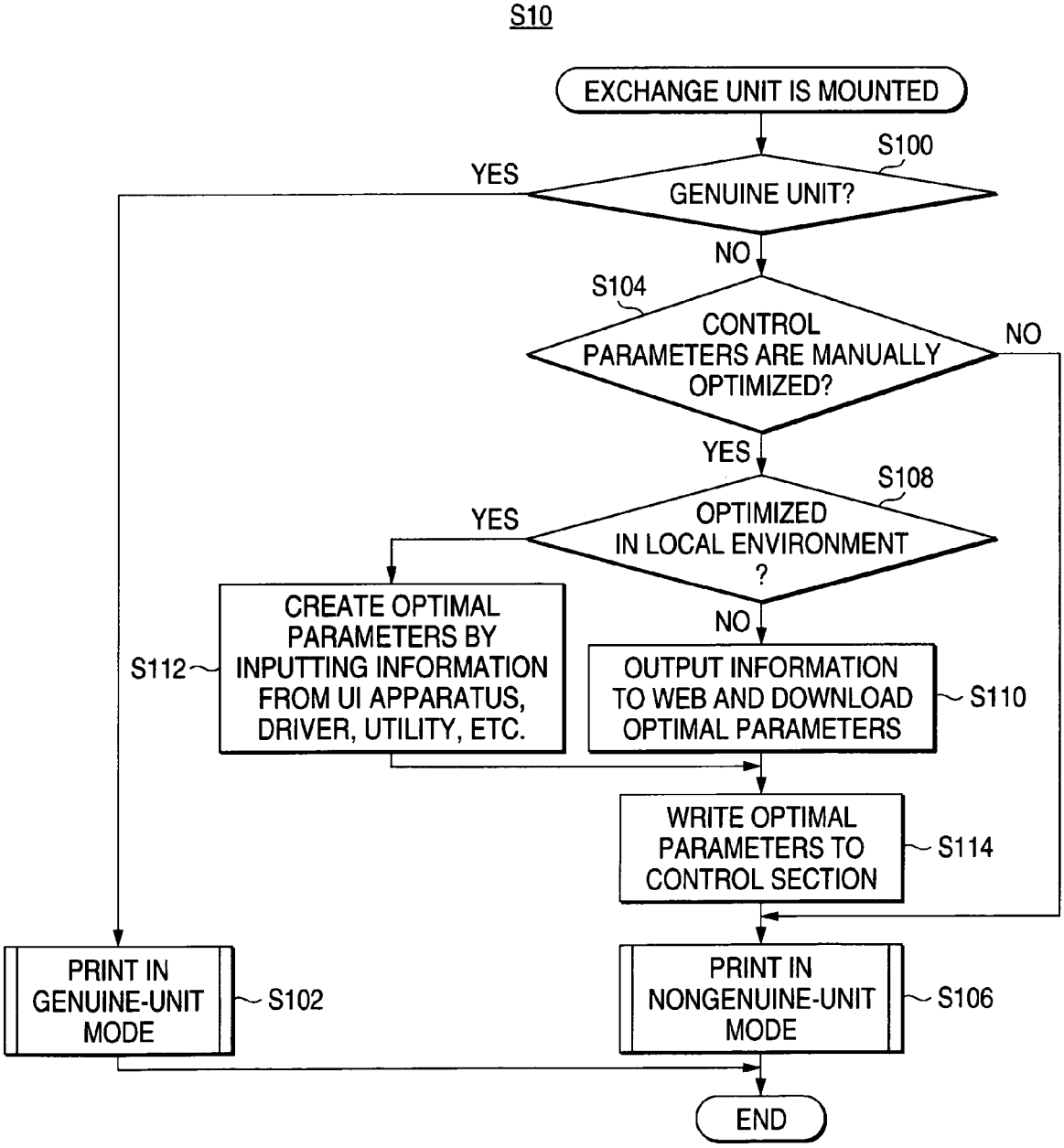
FIG. 21 is a flowchart (S10) illustrating a control flow of the image forming apparatus in a case where an exchange unit is mounted therein.

FIG. 21 is a flowchart (S10) illustrating a control flow of the image forming apparatus 10 in a case where an exchange unit is mounted therein.

When the exchange unit is mounted therein, first, it is judged at step 100 (S100) whether or not the exchange unit is a genuine one. If judged that the exchange unit is a genuine one, control proceeds to step 102 (S102), whereupon printing is performed in the default mode. Then, the process is finished.

If it is judged at step 100 (S100) that the exchange unit is not genuine, namely, that the exchange unit is a nongenuine one, it is judged at the next step 104 (S104) whether or not the control parameters are manually optimized. The judgment at this step 104 (S104) is performed according to a user's selection inputted to the UI apparatus 18.

If it is judged at step 104 (S104) that the control parameters are not optimized manually (N), control proceeds to step 106 (S106), whereupon printing is performed in a nongenuine-unit mode. Then, the processing is finished. Conversely, if it is judged at step 104 (S104) that the control parameters are optimized manually (Y), control proceeds to the next step 108 (S108), whereupon it is judged whether or not the control parameters are optimized in a local environment. The judgment at this step 108 (S108) is performed according to the user's selection, which is inputted to the UI apparatus 18. If it is judged at this step 108 (S108) that the control parameters are not optimized in the local environment (N), control advances to step 110 (S110), whereupon information is outputted to a Web and optimal parameters are downloaded therefrom, as will be described later. Conversely, if it is judged at step 108 (S108) that the control parameters are optimized in the local environment (Y), control proceeds to step 112 (S112), whereupon optimal parameters are generated according to information inputted from a driver and a utility, which are installed in the UI apparatus 18 and the host apparatus 2. Then, when processing at step 110 (S110) or at step 112 (S112) is finished, control proceeds to step 114 (S114), whereupon the control parameters are set at the information control section 302. Subsequently, control advances to step 106 (S106), whereupon printing is performed in the nongenuine-unit mode.

Figure 22:
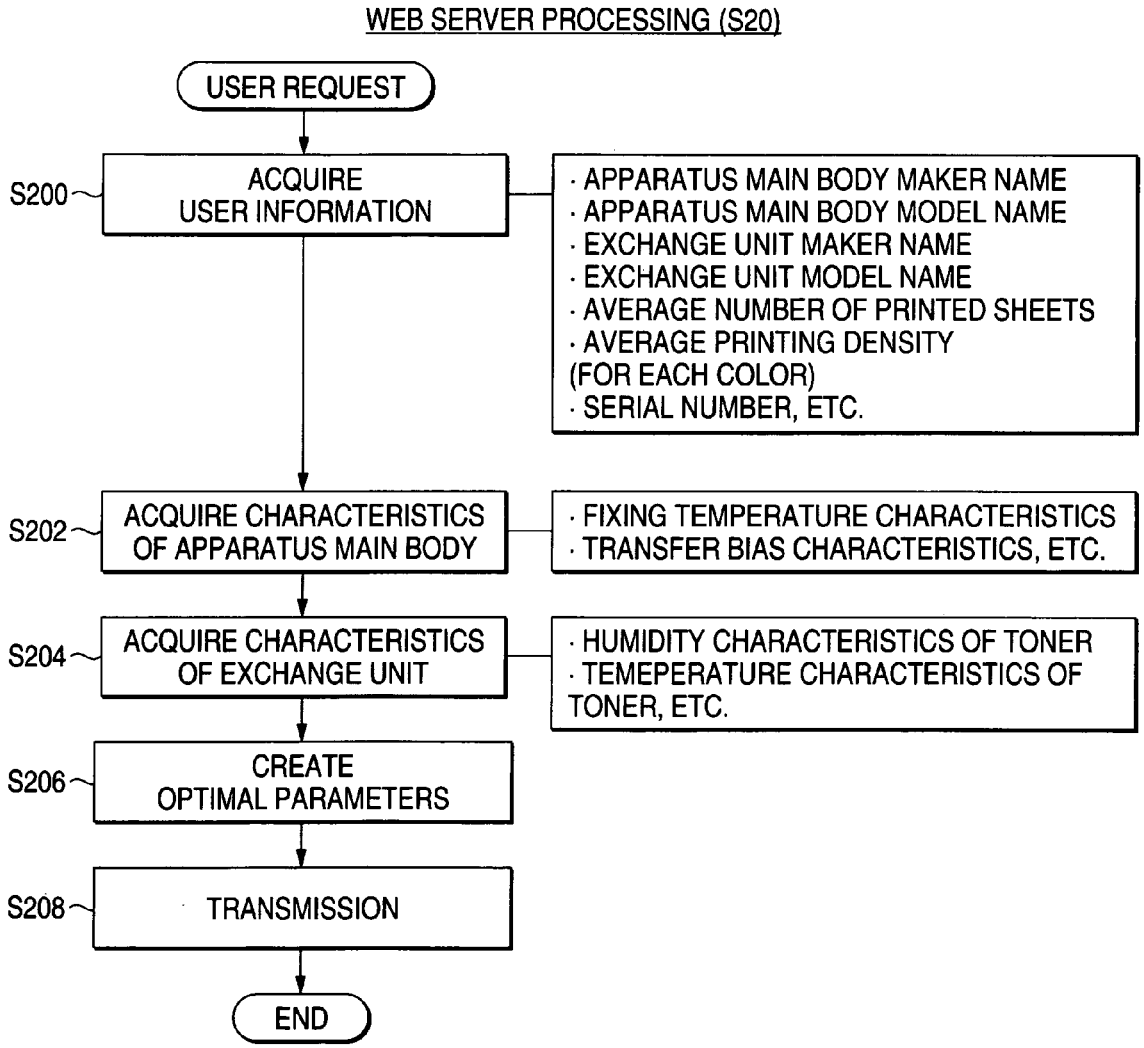
FIG. 22 is a flowchart (S20) illustrating a control flow of a Web server 304, which is performed upon a user request.

FIG. 22 is a flowchart (S20) illustrating a control flow of a Web server 304, which is performed upon a user request.

At a user request, first, user information representing a current situation, which is notified by a user or the control portion 106 of the image forming apparatus 10, is acquired at step 200 (S200). The user information includes an apparatus main body maker name, an apparatus main body model name, an exchange unit maker name, an exchange unit model name, an average number of printed sheets, an average printing density for each color, serial numbers of the apparatus main body and the exchange units and so on. At the next step 202 (S202), a database 306 is searched according to the user information. Thus, information on the characteristics of an associated apparatus main body is acquired. The information on the characteristics of the associated apparatus main body includes information on fixing temperature characteristics and transfer bias characteristics thereof. At the next step 204 (S204), the database 306 is searched according to the user information. Thus, information on the characteristics of an associated exchanged unit is acquired. The information on the characteristics of the associated exchange unit includes information on humidity characteristics and temperature characteristics of the toner. Then, at the next step 206 (S206), optimal parameters are generated according to the user information acquired at step 200 (S200), the information on the characteristics of the apparatus main body, which is acquired at step S202 (S202), and the information on the characteristics of the exchange unit, which is acquired at step 204 (S204). At the next step 208 (S208), the optimal parameters are transmitted.

Incidentally, although the foregoing description of the embodiment has described the case where the exchange unit is the toner cartridge, the invention is not limited thereto. The invention can be applied to cases of employing other exchange units.

What is claimed is:

1. An image forming system comprising:

an image forming apparatus, which includes:

an apparatus main body;

at least one exchange unit, exchangeably mounted in the main body, including toner; and a control unit, including an image density sensor, for performing a control operation by selecting one of a first operation mode, which is associated with an exchange unit that is a genuine unit, and a second operation mode, which is associated with an exchange unit that is other than genuine units, for adjusting toner output to maintain image density based on the image density sensor and for adjusting temperature and relative humidity parameters to adjust toner density, and a providing unit for providing a control parameter, which are applied to the second operation mode, to the control unit.

2. The image forming system according to claim 1, wherein the control parameter provided by the providing unit relates to a consumed amount of an exchange unit.

3. The image forming system according to claim 1, wherein the control parameter provided by the providing unit relates to an environment of the image forming apparatus.

4. The image forming system according to claim 1, wherein the providing unit is provided in a host apparatus connected to the image forming apparatus.

5. The image forming system according to claim 1, wherein the providing unit is provided in a Web server, and provides the control parameter through the Internet.

6. An image forming system comprising:

an image forming apparatus, which includes:

an apparatus main body;

at least one exchange unit, exchangeably mounted in the main body, including toner; and a control unit, including an image density sensor, for performing a control operation by selecting one of a first operation mode, which is associated with an exchange unit that is a genuine unit, and a second operation mode, which is associated with an exchange unit that is other than genuine units, for adjusting toner output to maintain image density based on the image density sensor and for adjusting temperature and relative humidity parameters to adjust toner density, and a host apparatus connected to the image forming apparatus, wherein the host apparatus includes:

a providing unit for providing a control parameter, which is applied to the second operation mode, to the control unit.

7. An image forming system comprising:

an image forming apparatus, which includes:

an apparatus main body;

at least one exchange unit, exchangeably mounted in the main body, including toner; and a control unit, including an image density sensor, for performing a control operation by selecting one of a first operation mode, which is associated with an exchange unit that is a genuine unit, and a second operation mode, which is associated with an exchange unit that is other than genuine units, for adjusting toner output to maintain image density based on the image density sensor and for adjusting temperature and relative humidity parameters to adjust toner density, a host apparatus connected to the image forming apparatus, and a providing unit for providing a control parameter, which is applied to the second operation mode, to the control unit through the host apparatus.

8. An image forming system comprising:

an apparatus main body;

at least one exchange unit, exchangeably mounted in the main body, including toner;

a control unit, including an image density sensor, for performing a control operation by selecting one of a first operation mode, which is associated with an exchange unit that is a genuine unit, and a second operation mode, which is associated with an exchange unit that is other than genuine units, for adjusting toner output to maintain image density based on the image density sensor and for adjusting temperature and relative humidity parameters to adjust toner density;

an optimal control parameter generating unit for generating an optimal control parameter, which is applied to the second operation mode, and a providing unit for providing an optimal parameter, which is generated by the optimal control parameter generating unit, to the control unit through the host apparatus.

* * * * *